US007210452B2

(12) United States Patent
Nakashima et al.

(10) Patent No.: US 7,210,452 B2
(45) Date of Patent: May 1, 2007

(54) CONTROL APPARATUS OF INTERNAL COMBUSTION ENGINE

(75) Inventors: Shogo Nakashima, Tokyo (JP); Ikuo Musa, Tokyo (JP); Ken Tachibana, Hyogo (JP); Masato Oonishi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/318,547

(22) Filed: Dec. 28, 2005

(65) Prior Publication Data

US 2007/0017482 A1 Jan. 25, 2007

(30) Foreign Application Priority Data

Jul. 19, 2005 (JP) ..... P2005-208716

(51) Int. Cl.
*F02D 9/10* (2006.01)

(52) U.S. Cl. ..... 123/399; 123/361

(58) Field of Classification Search ..... 123/361, 123/399, 337

See application file for complete search history.

(56) References Cited

U.S. PATENT DOCUMENTS 4,850,319 A * 7/1989 Imoehl ..... 123/361
4,947,815 A * 8/1990 Peter ..... 123/399
5,078,110 A * 1/1992 Rodefeld ..... 123/399
5,275,146 A * 1/1994 Yamashita ..... 123/549
5,912,538 A * 6/1999 Turner ..... 318/280
6,167,866 B1 * 1/2001 Jakisch et al. ..... 123/399
6,431,144 B1 * 8/2002 Daly ..... 123/399

FOREIGN PATENT DOCUMENTS

JP 59-188050 A 10/1984
JP 2000-320348 A 11/2000

* cited by examiner

*Primary Examiner*—Erick Solis
(74) *Attorney, Agent, or Firm*—Sughrue Mion, PLLC

(57) ABSTRACT

A control apparatus of an internal combustion engine, for preventing a throttle valve from freezing when the internal combustion engine is stopped. A control unit is constructed to receive power from a battery ancillary to an internal combustion engine when the internal combustion engine is stopped and perform a probability determination of whether or not the probability of a throttle valve freezing is high. When this probability is high, the control unit controls the throttle valve to execute a freeze protection operation, including a valve opening and closing operation of the throttle valve, before the throttle valve freezes. The probability determination is carried out using environmental temperature detecting means, engine temperature detecting means, date/time information outputting means, location information detecting means, and a drive level of an exhaust recirculating device.

13 Claims, 12 Drawing Sheets

CONTROL APPARATUS OF INTERNAL COMBUSTION ENGINE

BACKGROUND OF THE INVENTION

1. Field of the Invention

This invention relates to a control apparatus of an internal combustion engine, and particularly to a control apparatus of an internal combustion engine for preventing trouble of a throttle valve of the internal combustion engine freezing up.

2. Description of the Related Art

In winter, trouble sometimes arises of dew condensing on the throttle valve of an internal combustion engine of an automotive vehicle and water droplets forming as a result of this dew condensation then freezing and the throttle valve freezing up. As processes by which this trouble of throttle valve freezing occurs, the following examples are known.

When an internal combustion engine is running, a flow of air in an intake pipe is constricted by a throttle valve. As a consequence of this flow of air being constricted by the throttle valve, the flow speed of the air in the intake pipe increases sharply in the vicinity of the throttle valve. Along with the increase in the flow speed, the air flowing through the vicinity of the throttle valve is sharply reduced in pressure, and the temperature of that air falls. In environments where the outside temperature is low, in places where the humidity is high such as on sea coasts and by rivers, when the internal combustion engine is operated from cold to warm, as a consequence of the reduction in pressure of the air in the vicinity of the throttle valve and the fall in air temperature, water vapor in the intake air condenses as dew on the throttle valve to form water droplets, and these water droplets freeze.

When the internal combustion engine is running, with the flow of air in the intake pipe being constricted by the throttle valve, the pressure in the intake pipe is reduced by the internal combustion engine, and when the internal combustion engine is stopped in this state, because the pressure in the intake pipe rises to atmospheric pressure, air flows into the intake pipe. When at this time the throttle valve is fully closed, a phenomenon of gas in the combustion chambers of the internal combustion engine flowing back into the intake pipe through the intake valves of the internal combustion engine occurs; in an internal combustion engine equipped with an exhaust recirculating device for recirculating exhaust gas into the intake pipe, a phenomenon of post-combustion gas in the combustion chambers flowing into the intake pipe through the exhaust recirculating device occurs; in a vehicle equipped with a positive crankcase ventilation device, a phenomenon of gas in the crankcase of the internal combustion engine flowing into the intake pipe through the positive crankcase ventilation device occurs; and in an internal combustion engine equipped with a fuel transpiration gas circulating device, a phenomenon of gas in the fuel tank flowing into the intake pipe through the fuel transpiration gas circulating device occurs.

Because these gases flowing into the intake pipe are all high-temperature, high-humidity gases, the intake pipe becomes filled with high-temperature, high-humidity gas. When in this state a throttle body incorporating the throttle valve is cooled by a low outside air temperature, the high-temperature, high-humidity gas in contact with the inner surface of the throttle body is cooled, water vapor in the gas condenses on the inner surface of the throttle body, and water droplets form. And also when high-temperature, high-humidity gas flows into a throttle body already cooled by low-temperature outside air, because this high-temperature, high-humidity gas makes contact with the inner surface of the cooled throttle body, the high-temperature, high-humidity gas is cooled, water vapor in the gas condenses on the inner surface of the throttle body, and water droplets form. And trouble arises of water droplets condensed on the inner surface of the throttle body collecting at the bottom of the throttle valve under gravity and surface tension and then freezing at the bottom of the throttle valve as the outside air temperature falls and causing the throttle valve to freeze up.

When this trouble of the throttle valve freezing occurs, as a result of the intake passage of the internal combustion engine being blocked, a situation in which good startability cannot be ensured when an attempt is made to start the internal combustion engine arises, and there is a risk of the vehicle becoming immobile.

Related art concerned with this problem includes JP-A-59-188050 (Related Art 1) and JP-A-2000-320348 (Related Art 2). In Related Art 1, in an apparatus in which while an internal combustion engine is running a target throttle aperture corresponding to the operating state of the engine is obtained and the aperture of a throttle valve is regulated to this target throttle aperture by means of an actuator, when the engine is operating in a low outside air temperature the throttle valve is oscillated in the vicinity of the target throttle aperture to remove water droplets condensed on the throttle valve and thereby prevent trouble of the throttle valve freezing.

In Related Art 2, in an apparatus in which while an internal combustion engine is running a target throttle aperture corresponding to the operating state of the engine is obtained and the aperture of a throttle valve is regulated to this target throttle aperture by means of an actuator, when the engine is started in a low outside air temperature, in a state before the internal combustion engine proceeds to full combustion, to prevent trouble of the throttle valve freezing, the throttle valve is made to oscillate greatly by the target throttle aperture being made to fluctuate greatly.

Related Art 1: JP-A-59-188050

Related Art 2: JP-A-2000-320348

However, in Related Art 1, although water droplets condensing as dew on the throttle valve while the engine is running can be removed, it is not possible to prevent dew condensation and freezing of water droplets forming as a result of this dew condensation after the-engine stops, and it is impossible to eliminate trouble of the throttle valve freezing after the internal combustion engine stops.

And, if condensed water droplets freeze 100% and the throttle valve reaches a throttle-frozen state, to oscillate the throttle valve to eliminate this throttle-frozen state a large shear torque is necessary, and with actuators normally used the situation often arises that the shear torque is insufficient and the freezing cannot be overcome. In Related Art 1, 2, because freezing of the throttle valve due to freezing of water droplets cannot be eliminated with certainty, the problem arises that sure startability cannot be guaranteed and it is difficult to prevent certainly a situation of the vehicle becoming immobile.

And, when a frozen throttle valve is oscillated forcefully, there is a risk of stress accompanying that oscillation causing damage to the throttle valve and its drive mechanism. And when an excessive current flows through a motor for driving the throttle valve, there is a risk of the drive motor burning out.

SUMMARY OF THE INVENTION

The present invention was made in view of the problems described above, and provides a control apparatus of an internal combustion engine with which, while the internal combustion engine is stopped, it is possible to prevent trouble of a throttle valve freezing.

The invention provides a control apparatus of an internal combustion engine including: a battery ancillary to the internal combustion engine; a control unit for receiving power from the battery and controlling the internal combustion engine; and a throttle valve drive device for receiving power from the battery and driving a throttle valve of the internal combustion engine, the control apparatus of the internal combustion engine regulating the valve aperture of the throttle valve by controlling the throttle valve drive device while the internal combustion engine is running, wherein while the internal combustion engine is stopped the control unit receives power from the battery and performs a probability determination of whether or not the probability of the throttle valve freezing is high, and when while the internal combustion engine is stopped it determines that the probability of the throttle valve freezing is high the control unit, before the throttle valve reaches a throttle-frozen state, controls the throttle valve drive device so that the throttle valve drive device receives power from the battery and executes a freeze protection operation of oscillating the valve aperture of the throttle valve.

In a control apparatus of an internal combustion engine according to the invention, because when the internal combustion engine is stopped the control unit receives power from a battery and performs a probability determination of whether or not the probability of a throttle valve freezing is high and when the control unit determines that the probability of the throttle valve freezing is high, before the throttle valve reaches a throttle-frozen state, it controls the throttle valve drive device so that the throttle valve drive device receives power from the battery and executes a freeze protection operation of oscillating the valve aperture of the throttle valve, without adding a special control unit for throttle freeze protection operation it is possible certainly to prevent the throttle valve from freezing while the internal combustion engine is stopped and it is possible to provide sure startability and certainly prevent the vehicle from becoming immobile. And, damage to the throttle valve and the throttle mechanism and burning out of the throttle valve drive device can also be prevented. Furthermore, because freezing protection operation is not carried out when the probability of freezing of the throttle valve occurring is low, battery energy can be saved and the lives of the throttle valve, the throttle mechanism and the throttle valve drive device can be extended.

DETAILED DESCRIPTION OF THE PREFERRED EMBODIMENTS

A number of preferred embodiments of a control apparatus of an internal combustion engine according to the invention will be described below with reference to the accompanying drawings.

First Preferred Embodiment

Figure 1:
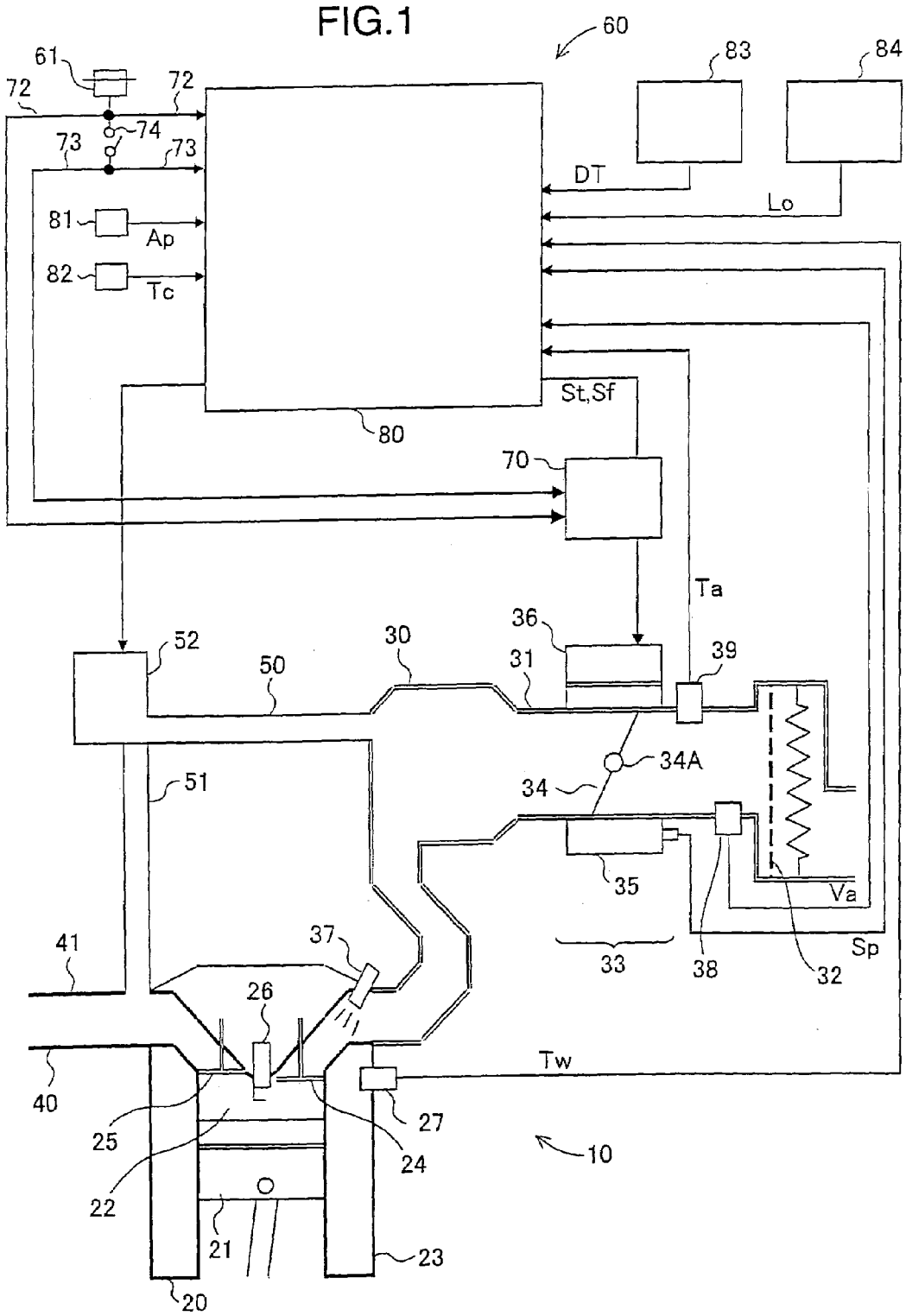
FIG. 1 is a schematic view showing a first preferred embodiment of a control apparatus of an internal combustion engine according to the invention.

FIG. 1 is an overall construction view showing a first preferred embodiment of a control apparatus of an internal combustion engine according to the invention. The internal combustion engine control apparatus of this first preferred embodiment is a control apparatus of an internal combustion engine mounted in an automotive vehicle. The internal combustion engine control apparatus of the first preferred embodiment shown in FIG. 1 has an internal combustion engine 10 and a control system 60 of this internal combustion engine 10.

The internal combustion engine 10 has an internal combustion engine proper 20, an intake system 30, an exhaust system 40, and an exhaust recirculating device 50. The internal combustion engine proper 20 has a cylinder 23 with a piston 21 and a combustion chamber 22. An intake valve 24, an exhaust valve 25 and a spark plug 26 are provided in the combustion chamber 22. The intake valve 24 and the exhaust valve 25 are opened and closed by a cam (not shown). When the intake valve 24 opens, a mixture of air and fuel is supplied from the intake system 30 into the combustion chamber 22. The spark plug 26 ignites the mixture supplied into the combustion chamber 22 and causes the mixture to combust inside the combustion chamber 22. The piston 21 is driven by this combustion of the mixture. When the exhaust valve 25 is opened, exhaust gas is discharged from the combustion chamber 22 into the exhaust system 40.

A cooling water temperature sensor 27 is provided in the cylinder 23. This cooling water temperature sensor 27 includes an engine temperature detecting means of the internal combustion engine. This cooling water temperature sensor 27 detects the temperature of cooling water of the internal combustion engine supplied to the cylinder 23 and outputs engine temperature information Tw proportional to this cooling water temperature. The cooling water temperature is proportional to the temperature of the cylinder 23, and the engine temperature information Tw has a size proportional to the temperature of the internal combustion engine proper 20.

The intake system 30 has an intake pipe 31, an air filter 32, a throttle body 33 and a fuel injection valve 37. The intake pipe 31 is connected to the combustion chamber 22 via the intake valve 24. The throttle body 33 is disposed in the intake pipe 31 on the downstream side of the air filter 32. This throttle body 33 has a throttle valve 34, a throttle position sensor 35 and a throttle valve drive device 36.

The throttle valve 34 is disposed so as to cross an intake passage inside the intake pipe 31, and rotates about a rotary shaft 34A to open and close the intake passage inside the intake pipe 31. In FIG. 1 the throttle valve 34 is shown in a fully closed state, and in this state the throttle valve aperture is 0% and the intake passage is blocked. In FIG. 1, when the throttle valve 34 rotates in the clockwise direction about the rotary shaft 34A, the throttle valve aperture increases. When the throttle valve 34 has become parallel with the intake passage, the throttle valve 34 is fully open, and the throttle valve aperture is 100%. The throttle valve aperture is regulated between 0 and 100%. When the throttle valve aperture is 50%, the throttle valve 34 is half open.

The throttle position sensor 35 and the throttle valve drive device 36 are ancillary to the throttle valve 34. The throttle position sensor 35 is disposed facing the throttle valve 34 outside the intake pipe 31, and generates throttle position information Sp proportional to the position of the throttle valve 34, that is, the throttle valve aperture. The throttle valve drive device 36 consists of for example a throttle drive motor. This throttle valve drive device 36 is also disposed facing the throttle valve 34 outside the intake pipe 31, and rotates the rotary shaft 34A to turn the throttle valve 34 about the axis of the rotary shaft 34A. The throttle valve aperture is regulated by this throttle valve drive device 36.

The fuel injection valve 37 is disposed inside the intake pipe 31 in the vicinity of the intake valve 24 in the internal combustion engine proper 20. This fuel injection valve 37 injects a calculated amount of fuel immediately in front of the intake valve 24 and thereby creates a mixture of air and fuel. By the amount of fuel injected by the fuel injection valve 37 being calculated, the air-fuel ratio of this mixture is regulated to approach a theoretical air-fuel ratio.

An airflow sensor 38 and an intake air temperature sensor 39 are disposed in the intake pipe 31 upstream of the throttle valve 34. The airflow sensor 38 detects the flowrate of air supplied to the combustion chamber 22 through the throttle valve 34 and outputs intake airflow information Va proportional to this flowrate. The intake air temperature sensor 39 constitutes intake air temperature detecting means. This intake air temperature sensor 39 detects the temperature of air flowing into the combustion chamber 22 through the throttle valve 34 and outputs intake air temperature information Ta proportional to this air temperature.

The exhaust system 40 has an exhaust pipe 41. This exhaust pipe 41 is connected to the combustion chamber 22 via the exhaust valve 25.

The exhaust recirculating device 50 has an exhaust recirculating passage 51 and a recirculating valve device 52. The exhaust recirculating passage 51 connects the exhaust pipe 41 to the intake pipe 31 downstream of the throttle valve 34. This exhaust recirculating passage 51 recirculates some of the exhaust gas in the exhaust pipe 41 to the intake pipe 31 so that it is fed into the combustion chamber 22 with the mixture gas and lowers the combustion temperature inside the combustion chamber 22, whereby harmful components in the exhaust gas are reduced. The-recirculating valve device 52 includes the recirculating valve and a drive device thereof, and the recirculating valve is disposed as to cross the exhaust recirculating passage 51. The recirculating valve device 52 controls the exhaust recirculating passage 51 in correspondence with its valve aperture and thereby regulates the amount of exhaust gas recirculated to the intake pipe 31.

The control system 60 has a battery 61 ancillary to the internal combustion engine 10, a throttle opening/closing control device 70 connected between this battery 61 and the throttle valve drive device 36, and a control unit 80 that receives a supply of electrical power from the battery 61. The battery 61 is for example a 12V system battery, and in a normal state has an output voltage of approximately 13V. The throttle opening/closing control device 70 opens and closes power supply paths between the battery 61 and the throttle valve drive device 36. These power supply paths include a direct power supply path 72 and an ignition power supply path 73. An ignition switch 74 that is ON while the internal combustion engine 10 is running is connected to the ignition power supply path 73. While the internal combustion engine 10 is running, power is supplied from the battery 61 to the throttle valve drive device 36 via the ignition power supply path 73 and via the throttle opening/closing control device 70, and when the internal combustion engine 10 is stopped, power is supplied from the battery. 61 to the throttle valve drive device 36 via the direct power supply path 72 and the throttle opening/closing control device 70. The throttle opening/closing control device 70 can be incorporated directly into the control unit 80.

The control unit 80 is-constructed using for example a microcomputer. The control-unit 80 receives a supply of power from the battery 61 via the direct power supply path 72 and the ignition power supply path 73. The direct power supply path 72 connects the battery 61 and the control unit 80 together at all times. When the internal combustion engine 10 is stopped, because the ignition switch 74 is OFF, the control unit 80 receives power from the battery 61 via the direct power supply path 72.

The engine temperature information Tw from the cooling water temperature sensor 27, the throttle position information Sp from the throttle position sensor 35, the intake airflow information Va from the airflow sensor 38 and the intake air temperature information Ta from the intake air temperature sensor 39 are inputted to the control unit 80. Also ancillary to the control unit 80 are an accelerator position sensor 81, an environmental temperature sensor 82, date/time information outputting means 83, and a location sensor 84. In correspondence with the position of an accelerator pedal operated by a driver of the automotive vehicle, the accelerator position sensor 81 outputs accelerator position information Ap proportional to the amount by which this accelerator pedal is being depressed.

The environmental temperature sensor 82 constitutes environmental temperature detecting means. This environmental temperature sensor 82 detects the environmental temperature around the internal combustion engine 10 and generates environmental temperature information Tc proportional to this environmental temperature. Specifically, this environmental temperature sensor 82 detects the air temperature inside the engine compartment of the vehicle, the air temperature around the intake pipe 31 in the vicinity of the throttle valve 34, or the surface temperature of the intake pipe 31 in the vicinity of the throttle valve 34.

The date/time information outputting means 83 outputs date/time information DT including date information and time information corresponding to a calendar. This date/time information outputting means 83 can alternatively be incorporated directly into the control unit 80. The location sensor 84 detects the location of the internal combustion engine 10 on a map and outputs location information Lo corresponding to this location. The accelerator position information Ap, the environmental temperature information Tc, the date/time information DT and the location information Lo are also inputted to the control unit 80.

The control unit 80 performs control of a fuel injection quantity of the fuel injection valve 37, control of the exhaust gas recirculation flow of the exhaust recirculating device 50, control of a target throttle valve aperture of the throttle valve 34, and control of the throttle freeze protection operation of the throttle valve 34. The control of the fuel injection quantity, the control of the exhaust gas recirculation flow and the control of the target throttle valve aperture are performed while the internal combustion engine 10 is running, and the control unit 80 receives power from the battery 61 via the ignition power supply path 73 and the ignition switch 74 to perform this control. The control of the throttle freeze protection operation is performed when the internal combustion engine 10 is stopped, and the control unit 80 receives power from the battery 61 via the direct power supply path 72 to perform this throttle freeze protection operation control.

In the control of the fuel injection quantity, the control unit 80 calculates a fuel injection quantity appropriate to the intake air mainly on the basis of the engine temperature information Tw, the intake airflow information Va and the intake air temperature information Ta, and, in synchrony with information on the angular position of the internal combustion engine 10 from a crank angle sensor (not shown), feeds a fuel injection time corresponding to that calculated fuel injection quantity to the fuel injection valve 37. In the control of the exhaust gas recirculation flow, the control unit 80 calculates a valve aperture of the recirculating valve device 52 mainly on the basis of information on the speed of the internal combustion engine 10 from the crank angle sensor (not shown), the intake airflow information Va and the engine temperature information Tw, and drives this recirculating valve device 52 to that calculated valve aperture. In the control of the target throttle valve aperture, the control unit 80 calculates a target throttle valve aperture mainly on the basis of the accelerator position information Ap and the throttle position information Sp, and on the basis of this target throttle valve aperture feeds a target valve aperture control signal St to the throttle opening/closing control device 70 and thereby controls the throttle valve drive device 36 to the target valve aperture.

In the throttle freeze protection operation control, using the environmental temperature information Tc, the engine temperature information Tw, the intake air temperature information Ta, the date/time information DT or the location information Lo of when the internal combustion engine 10 is stopped, or using a drive level of the recirculating valve device 52 of when the internal combustion engine 10 is running, on the basis of these the control unit 80 performs a probability determination of whether or not the probability of the throttle valve 34 freezing is high, and when it determines that the probability of the throttle valve 34 freezing is high it feeds a throttle freeze protection signal Sf to the throttle opening/closing control device 70 and supplies power from the battery 61 to the throttle valve drive device 36 through this throttle opening/closing control device 70 and causes it to perform a throttle freeze protection operation of oscillating the throttle valve aperture.

Next, the operation of the apparatus described above will be described. While the internal combustion engine 10 is running, a driver operates the accelerator pedal (not shown). The amount of depression of the accelerator pedal is converted into accelerator position information Ap by the accelerator position sensor 81 and inputted to the control unit 80. The control unit 80 calculates a target valve aperture of the throttle valve 34 on the basis of the inputted accelerator position information Ap and throttle position information Sp, and supplies a target valve aperture control signal St corresponding to this target valve aperture to the throttle opening/closing control device 70. In accordance with the target valve aperture control signal St, the throttle opening/closing control device 70 controls the throttle valve drive device 36 to regulate the valve aperture of the throttle valve 34 to the target valve aperture.

The flow of air supplied to the combustion chamber 22 through the intake pipe 31 is measured by the airflow sensor 38 and inputted to the control unit 80 as the intake airflow information Va. The temperature of the air supplied to the combustion chamber 22 through the intake pipe 31 is measured by the intake air temperature sensor 39 and inputted to the control unit 80 as the intake air temperature information Ta. The temperature of the cooling water supplied to the cylinder 23 is detected by the cooling water temperature sensor 27 and inputted to the control unit 80 as the engine temperature information Tw.

The control unit 80 calculates a fuel injection quantity on the basis of the intake airflow information Va, the intake air temperature information Ta and the engine temperature information Tw, and, at an angular position based on angular position information inputted from the crank angle sensor (not shown), injects that fuel injection quantity through the fuel injection valve 37. As a result of this injection of fuel, a mixture of air flowing in through the intake pipe 31 and fuel supplied through the fuel injection valve 37 is formed. This mixture flows into the combustion chamber 22 of the internal combustion engine 10 through the intake valve 24; is compressed; is ignited by a spark created by the spark plug 26, which is driven by the control unit 80; combusts; and exerts a driving torque through the piston 21 of the internal combustion engine 10.

Exhaust gas from the combustion is discharged through the exhaust valve 25 into the exhaust pipe 41. Some of this exhaust gas flows into the exhaust recirculating passage 51 of the exhaust recirculating device 50. The control unit 80 calculates an exhaust recirculation quantity on the basis of speed information of the internal combustion engine 10 inputted from the crank angle sensor (not shown), the intake airflow information Va inputted from the airflow sensor 38, and the engine temperature information Tw inputted from the intake air temperature sensor 39, and regulates the valve aperture of the recirculating valve device 52 in correspondence with this exhaust recirculation quantity to control the exhaust recirculating passage 51. As the exhaust recirculating passage 51 is regulated by the recirculating valve device 52, exhaust gas from combustion flowing into the exhaust recirculating passage 51 flows into the intake pipe 31 under the negative pressure in the intake pipe 31.

In the first preferred embodiment, when the internal combustion engine 10 is stopped, the control unit 80 receives a supply of power from the battery 61 through the direct power supply path 72 and performs a probability determination of whether or not the probability of the throttle valve 34 freezing is high, on the basis of the environmental temperature information Tc from the environmental temperature sensor 82. When the inputted environmental temperature information Tc is below a predetermined value Tc0 (for example 0° C.), the control unit 80 determines that the probability of the throttle valve 34 freezing is high and controls the throttle opening/closing control device 70 to perform a throttle freeze protection operation.

In this throttle freeze protection operation, the control unit 80 sends the throttle freeze protection signal Sf to the throttle opening/closing control device 70. The throttle opening/closing control device 70 causes the throttle valve drive device 36 to execute the throttle freeze protection operation on the basis of the throttle freeze protection signal Sf from the control unit 80. In this throttle freeze protection operation, the throttle valve drive device 36 receives a supply of power from the battery 61 through the throttle opening/closing control device 70 and oscillates the valve aperture of the throttle valve 34.

Figure 2:
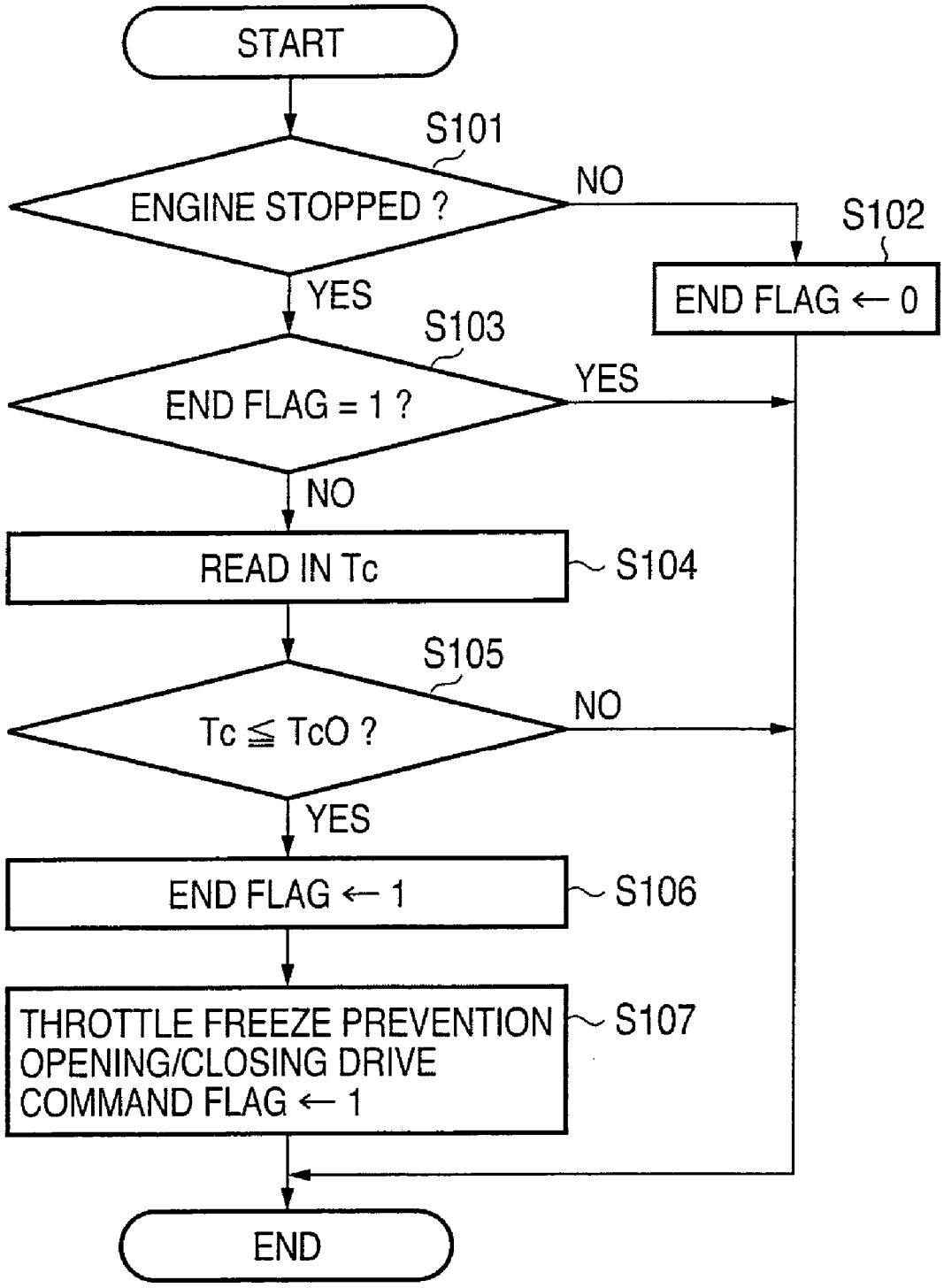
FIG. 2 is a control flow chart showing a throttle freeze protection operation in the first preferred embodiment.

The throttle freeze protection operation will now be explained with reference to the flow chart shown in FIG. 2. FIG. 2 is a control flow chart of the throttle freeze protection operation in the first preferred embodiment, and is executed at intervals of a predetermined time (for example every 20 ms). This throttle freeze protection operation of FIG. 2 includes seven steps S101 to S107.

First, in step S101, the control unit 80 determines on the basis of for example the signal from the crank angle sensor (not shown) whether the internal combustion engine 10 has stopped, and if this determination result is No processing proceeds to step S102 and sets an end flag to "0" and the routine ends. If the internal combustion engine 10 has stopped and the determination result of step S101 is therefore Yes, processing proceeds to step S103 and determines whether the end flag is "1". If the determination result of step S103 is Yes, it is inferred that the freeze protection operation of the throttle valve 34 has ended and the routine ends. When the end flag is not "1", the determination result of step S103 is No and processing proceeds to step S104.

In step S104, the environmental temperature information Tc from the environmental temperature sensor 82 is read in, and processing proceeds to the following step S105. In step S105, it is determined whether the environmental temperature information Tc inputted from the environmental temperature sensor 82 is below the predetermined value Tc0 (for example 0° C. or less). When the environmental temperature information Tc inputted from the environmental temperature sensor 82 is not below the predetermined value Tc0, the determination result of step S105 is No, it is inferred that it is not necessary to carry out a throttle freeze protection operation, and the routine ends. When the environmental temperature information Tc inputted from the environmental temperature sensor 82 is below the predetermined value Tc0, the determination result of step S105 is Yes, it is inferred that it is necessary to carry out a throttle freeze protection operation, and processing proceeds to the following steps S106, S107. In step S106 the end flag is set to "1", and in step S107 a throttle freeze prevention opening/closing drive command flag is set to "1" and the routine ends.

When the throttle freeze prevention opening/closing drive command flag is "1", in accordance with a control program (not shown) the control unit 80 supplies a throttle freeze protection signal Sf to the throttle opening/closing control device 70, and on the basis of this throttle freeze protection signal Sf the throttle opening/closing control device 70 executes a throttle freeze protection operation. In this throttle freeze protection operation, the throttle valve drive device 36 oscillates the valve aperture of the throttle valve 34.

On the basis of the throttle freeze protection signal Sf, in accordance with a control program (not shown) the throttle opening/closing control device 70 controls the throttle valve drive device 36 so as to change the throttle aperture for example from fully closed→half open→fully open→half open→fully closed. In this case, in accordance with the throttle freeze protection signal Sf the throttle opening/closing control device 70 controls the throttle valve 34 to perform one opening and closing movement in which it goes from fully closed to fully open and back to fully closed.

However, alternatively, when the internal combustion engine 10 is stopped the throttle opening/closing control device 70 may preparatorily bring the throttle valve 34 to a half-open state, and then, on the basis of the throttle freeze protection signal Sf, when the throttle freeze prevention opening/closing drive command flag is "1", control the throttle valve drive device 36 so that the throttle valve aperture changes from half open→fully open→half open→fully open→half open. In this case, the throttle opening/closing control device 70 controls the throttle valve 34 to perform one opening and closing movement in which it goes from half open to fully open and back to half open.

Or, the throttle valve aperture may be controlled to change from half open→fully open→half open→fully closed →half open, or the throttle valve aperture may be controlled to change from half open→fully closed→half open→fully closed→half open. In these cases, the throttle opening/closing control device 70 performs control to effect one opening and closing movement in which the throttle valve aperture goes from half open to fully closed and back to fully open.

When the internal combustion engine 10 is stopped, before the throttle valve 34 freezes, the control unit 80 performs a probability determination of whether or not the probability of the throttle valve 34 freezing is high, and when this probability is high it causes a throttle freeze protection operation to be executed before the throttle valve 34 becomes frozen. Freezing of the throttle valve 34 occurs as a result of dew condensation occurring on the throttle valve 34 and water droplets arising from this dew condensation then freezing. The state of water droplets arising from dew condensation on the throttle valve 34 having frozen 100% will be called the state of the throttle valve being frozen, that is, the throttle-frozen state. The throttle freeze protection operation conducted by the control unit 80 is executed before the water droplets arising from dew condensation have frozen 100%, and indeed before a semi-frozen state is reached in which the water droplets have frozen about 50%.

If a throttle freeze protection operation is executed when the water droplets arising on the throttle valve 34 from dew condensation are in a 0% frozen state, because by that throttle freeze protection operation it is possible to shake off the water droplets formed by dew condensation on the throttle valve 34, the throttle valve 34 can be prevented from progressing to a throttle-frozen state. And if the throttle freeze protection operation is executed with the water droplets condensed as dew on the throttle valve 34 in a semi-frozen state in which they are 50% frozen, because by that throttle freeze protection operation the water droplets having condensed as dew on the throttle valve 34 and ice formed by about half of that water freezing can be shaken off, similarly the throttle valve 34 can be prevented from progressing to a throttle-frozen state.

In the probability determination of whether or not the probability of the throttle valve 34 freezing is high, it is determined that the probability of the throttle valve 34 freezing is high when the environmental temperature information Tc is below the predetermined value Tc0 (for example 0° C.), and the predetermined value Tc0 in this probability determination is set so that if dew condensation on the throttle occurs, the throttle freeze protection operation is executed before those water droplets reach a semi-frozen state. As a result, in the throttle freeze protection operation, the throttle valve drive device 36 is prevented from consuming excessive energy, and damage to the throttle valve drive device 36 and the throttle valve 34 and its drive mechanism can also be avoided.

As described above, in the first preferred embodiment, because a throttle freeze protection operation of the throttle valve 34 is carried out and water droplets having formed on the throttle valve 34 and ice resulting from these water droplets partially freezing are removed before the throttle valve 34 freezes, freezing of the throttle valve can be prevented, and it is possible to guarantee sure startability and to prevent certainly a situation of the vehicle becoming immobile. And, damage of the throttle valve 34 and its throttle mechanism, and burning out of the throttle valve drive device 36, can be prevented. Furthermore, because no throttle freeze protection operation is carried out when the probability of the throttle valve 34 freezing is low, energy can be saved and the lives of the throttle valve 34, its throttle mechanism, and the throttle valve drive device 36 can be extended.

And, in this first preferred embodiment, because when the probability of the throttle valve 34 freezing is high the control unit 80 causes a throttle freeze protection operation to be carried out by supplying power from the battery 61 to the throttle valve drive device 36, the throttle freeze protection operation can be carried out when the internal combustion engine 10 is stopped by using the throttle valve drive device 36 provided for driving the throttle valve 34 when the internal combustion engine 10 is running, and thus the throttle freeze protection operation can be performed without a special throttle valve driving device being added.

Second Preferred Embodiment

In this second preferred embodiment, the probability determination of whether or not the probability of the throttle valve 34 freezing is high is carried out using the intake air temperature information Ta from the intake air temperature sensor 39 shown in FIG. 1, and when that probability is high, a throttle freeze protection operation is carried out. Whereas in the first preferred embodiment the environmental temperature information Tc from the environmental temperature sensor 82 was used, in the second preferred embodiment the intake air temperature sensor 39 is used instead of the environmental temperature sensor 82. Otherwise, it is the same as the first preferred embodiment. Because the overall construction, and operation when the internal combustion engine 10 is running, of this second preferred embodiment are the same as in the first preferred embodiment, a description of these will be omitted.

In this second preferred embodiment, after the internal combustion engine 10 stops, when the intake air temperature information Ta inputted from the intake air temperature sensor 39 is below a predetermined value (for example 0° C.), the control unit 80 determines that the probability of the throttle valve 34 freezing is high and sends a throttle freeze protection signal Sf to the throttle opening/closing control device 70. And in accordance with the throttle freeze protection signal Sf from the control unit 80, the throttle opening/closing control device 70 drives the throttle valve drive device 36 to oscillate the throttle valve 34.

Figure 3:
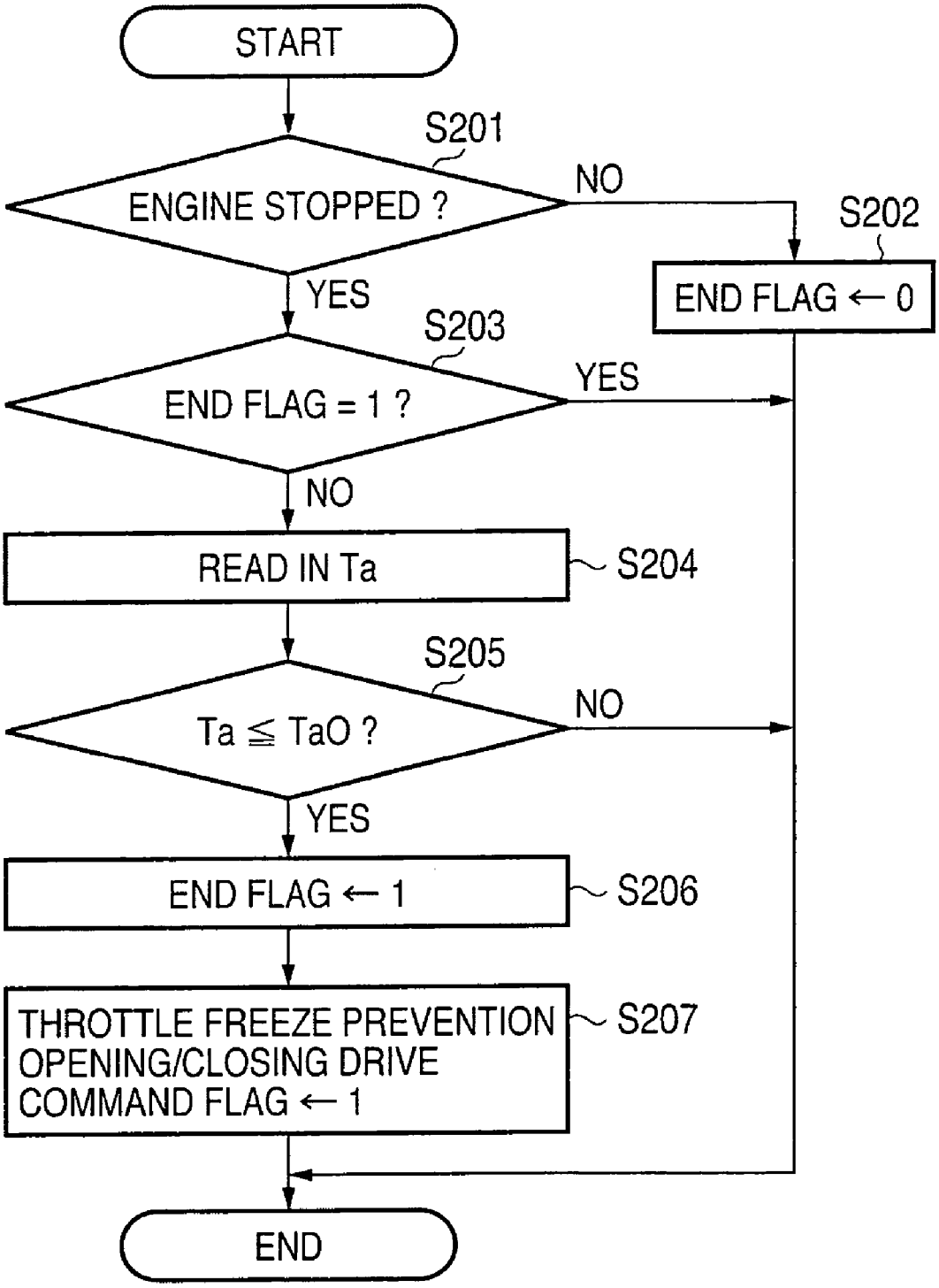
FIG. 3 is a control flow chart showing a throttle freeze protection operation in a second preferred embodiment of a control apparatus of an internal combustion engine according to the invention.

The throttle freeze protection operation of this second preferred embodiment will now be explained with reference to the flow chart of FIG. 3. FIG. 3 is a control flow chart of the throttle freeze protection operation of the second preferred embodiment, and the control routine of this FIG. 3 is executed at intervals of a predetermined time (for example every 20 ms). The control flow chart of FIG. 3 includes seven steps, S201 to S207. Steps S201, S202 and S203 are the same as steps S101, S102 and S103 in FIG. 2 and will not be described again here.

In step S203, when the end flag is not "1", because the determination result of step S203 is No, processing proceeds to the next step S204 and reads in the intake air temperature information Ta of inside the intake pipe 31 from the intake air temperature sensor 39. In the following step S205, it is determined whether the intake air temperature information Ta of inside the intake pipe 31 inputted from the intake air temperature sensor 39 is below a predetermined value Ta0 (for example below 0° C.). When the intake air temperature information Ta is below the predetermined value Ta0, the determination result of step S205 is No, it is inferred that it is not necessary to carry out a throttle freeze protection operation, and the routine ends. When the intake air temperature information Ta is below the predetermined value Ta0, the determination result of step S205 is Yes, it is inferred that it is necessary to carry out a throttle freeze protection operation, and in the next step S206 the end flag is set to "1", in step S207 the throttle freeze prevention opening/closing drive command flag is set to "1", and the routine ends.

In this second preferred embodiment also, when the throttle freeze prevention opening/closing drive command flag is "1", in accordance with a control program (not shown) the control unit 80 supplies a throttle freeze protection signal Sf to the throttle opening/closing control device 70, and on the basis of this throttle freeze protection signal Sf the throttle opening/closing control device 70 executes a throttle freeze protection operation. In this throttle freeze protection operation, the throttle valve drive device 36 oscillates the valve aperture of the throttle valve 34.

The throttle freeze protection operation in this second preferred embodiment is the same as the throttle freeze protection operation in the first preferred embodiment, and by this throttle freeze protection operation it is possible to prevent freezing of the throttle valve 34.

In this second preferred embodiment also, when the internal combustion engine 10 is stopped, before the throttle valve 34 freezes, the control unit 80 performs a probability determination of whether or not the probability of the throttle valve 34 freezing is high,and, when it determines that this probability is high, causes a throttle freeze protection operation to be executed before the throttle valve 34 reaches a throttle-frozen state. Freezing of the throttle valve 34 occurs as a result of dew condensing on the throttle valve 34 and water droplets arising from this dew condensation then freezing. The state of water droplets arising from dew condensation on the throttle valve 34 having frozen 100% is here called the state of the throttle valve being frozen, that is, the throttle-frozen state. The throttle freeze protection operation conducted by the control unit 80 is executed before the water droplets arising from dew condensation have frozen 100%, and indeed before the water droplets reach a semi-frozen state in which they have frozen about 50%.

If a throttle freeze protection operation is executed when the water droplets arising on the throttle valve 34 from dew condensation are in a 0% frozen state, because by that throttle freeze protection operation it is possible to shake off the water droplets formed by dew condensation on the throttle valve 34, the throttle valve 34 can be prevented from progressing to a throttle-frozen state. And if the throttle freeze protection operation is executed with the water droplets condensed as dew on the throttle valve 34 in a semi-frozen state in which they are 50% frozen, because by that throttle freeze protection operation the water droplets having condensed as dew on the throttle valve 34 and ice formed by about half of that water freezing can be shaken off, similarly the throttle valve 34 can be prevented from progressing to a throttle-frozen state.

In the probability determination of whether or not the probability of the throttle valve 34 freezing is high, it is determined that the probability of the throttle valve 34 freezing is high when the intake air temperature information Ta is below the predetermined value Ta0 (for example 0° C.), and the predetermined value Ta0 in this probability determination is set so that if dew condensation on the throttle occurs, the throttle freeze protection operation is executed before those water droplets reach a semi-frozen state. As a result, in the throttle freeze protection operation, the throttle valve drive device 36 is prevented from consuming excessive energy, and damage to the throttle valve drive device 36 and the throttle valve 34 and its drive mechanism can also be avoided.

The intake air temperature sensor 39 is a sensor used to calculate the fuel injection quantity of the fuel injection valve 37. In this second preferred embodiment, because the probability determination of whether or not the probability of the throttle valve 34 freezing is high is carried out on the basis of the intake air temperature information Ta inputted from the intake air temperature sensor 39, without any special sensor being added, freezing of the throttle valve 34 can be prevented without any increase in cost being incurred.

Third Preferred Embodiment

In this third preferred embodiment, a probability determination of whether or not the probability of the throttle valve 34 freezing is high is carried out using the engine temperature information Tw from the cooling water temperature sensor 27 shown in FIG. 1, and when that probability is high, a throttle freeze protection operation is carried out. Whereas in the first preferred embodiment the environmental temperature information Tc from the environmental temperature sensor 82 was used, in the third preferred embodiment the cooling water temperature sensor 27 is used instead of the environmental temperature sensor 82. Otherwise, it is the same as the first preferred embodiment. Because the overall construction, and operation when the internal combustion engine 10 is running, of this third preferred embodiment are the same as in the first preferred embodiment, a description of these will be omitted.

In this third preferred embodiment, after the internal combustion engine 10 stops, when the engine temperature information Tw inputted from the cooling water temperature sensor 27 is below a predetermined value Tw0 (for example 0° C.), the control unit 80 determines that the probability of the throttle valve 34 freezing is high and sends the throttle freeze protection signal Sf to the throttle opening/closing control device 70. In accordance with the throttle freeze protection signal Sf from the control unit 80, the throttle opening/closing control device 70 drives the throttle valve drive device 36 and thereby oscillates the valve aperture of the throttle valve 34.

Figure 4:
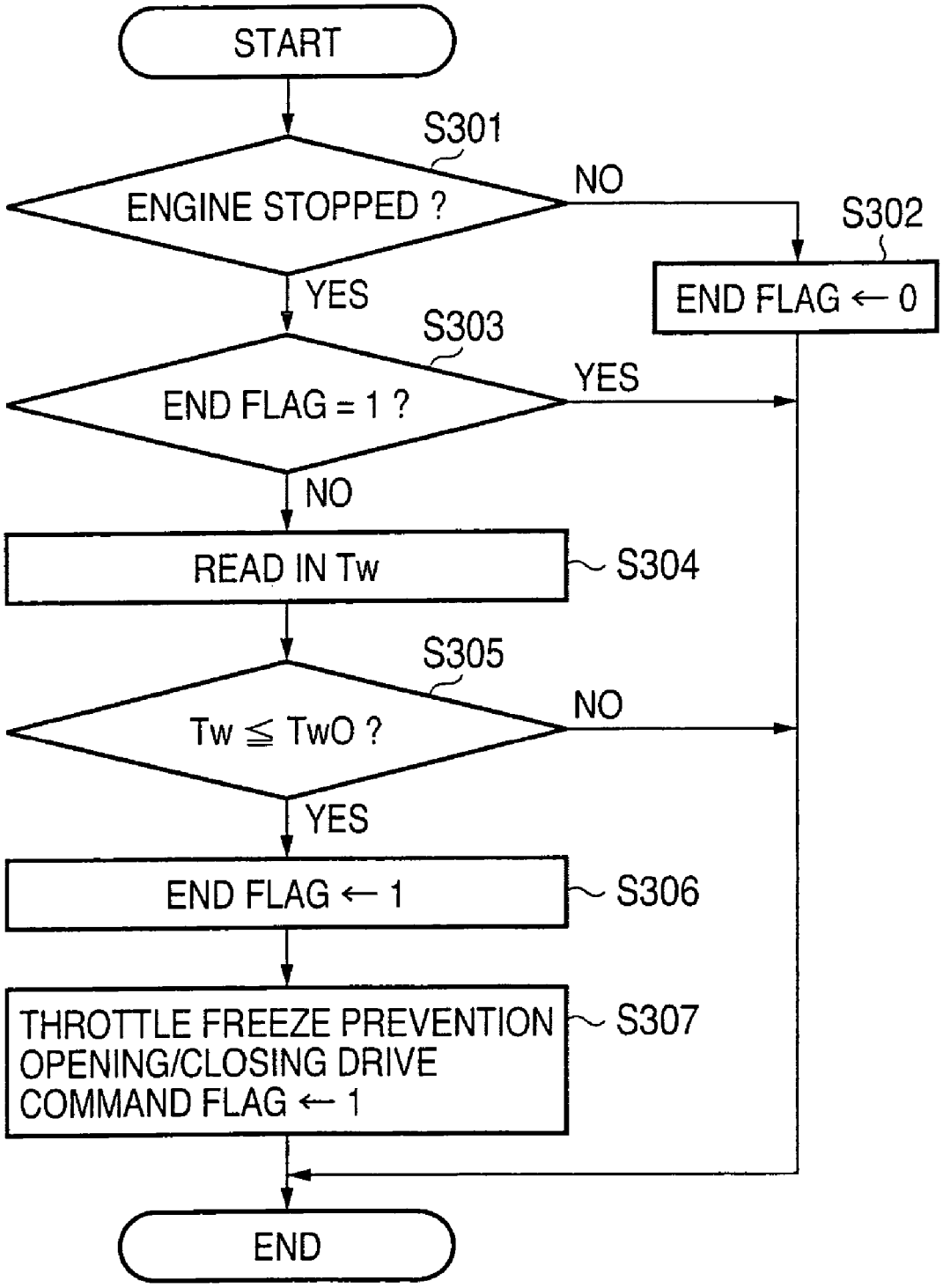
FIG. 4 is a control flow chart showing a throttle freeze protection operation in a third preferred embodiment of a control apparatus of an internal combustion engine according to the invention.

The throttle freeze protection operation in this third preferred embodiment will now be described with reference to the flow chart shown in FIG. 4. FIG. 4 is a control flow chart of the throttle freeze protection operation in the third preferred embodiment, and the control routine of this FIG. 4 is executed at intervals of a predetermined time (for example every 20 ms). The control flow chart of FIG. 4 includes seven steps S301 to S307. Steps S301, S302 and S303 are the same as steps S101, S102 and S103 of FIG. 2 and will not be described again here.

In step S303, when the end flag is not "1", because the determination result of step S303 is No, processing proceeds to the next step S304 and reads in the engine temperature information Tw from the cooling water temperature sensor 27. In the following step S305, it is determined whether the engine temperature information Tw is below the predetermined value Tw0 (for example below 0° C.). When the engine temperature information Tw is not below the predetermined value Tw0, the determination result of step S305 is No, it is inferred that it is not necessary to carry out a throttle freeze protection operation, and the routine ends. When the engine temperature information Tw is below the predetermined value Tw0, the determination result of step S305 is Yes, it is inferred that it is necessary to carry out a throttle freeze protection operation, in the following step S306 the end flag is set to "1", in step S307 the throttle freeze prevention opening/closing drive command flag is set to "1", and then the routine ends.

In this third preferred embodiment also, when the throttle freeze prevention opening/closing drive command flag is "1", in accordance with a control program (not shown) the control unit 80 supplies a throttle freeze protection signal Sf to the throttle opening/closing control device 70, and on the basis of this throttle freeze protection signal Sf the throttle opening/closing control device 70 executes a throttle freeze protection operation. In this throttle freeze protection operation, the throttle valve drive device 36 oscillates the valve aperture of the throttle valve 34.

The throttle freeze protection operation in this third preferred embodiment is the same as the throttle freeze protection operation in the first preferred embodiment, and by this throttle freeze protection operation it is possible to prevent freezing of the throttle valve 34.

In this third preferred embodiment also, when the internal combustion engine 10 is stopped, before the throttle valve 34 freezes, the control unit 80 performs a probability determination of whether or not the probability of the throttle valve 34 freezing is high, and, when it determines that this probability is high, causes a throttle freeze protection operation to be executed before the throttle valve 34 reaches a throttle-frozen state. Freezing of the throttle valve 34 occurs as a result of dew condensing on the throttle valve 34 and water droplets arising from this dew condensation then freezing. The state of water droplets arising from dew condensation on the throttle valve 34 having frozen 100% is here called the state of the throttle valve having frozen, that is, the throttle-frozen state. The throttle freeze protection operation conducted by the control unit 80 is executed before the water droplets arising from dew condensation have frozen 100%, and indeed before the water droplets reach a semi-frozen state in which they have frozen about 50%.

If a throttle freeze protection operation is executed when the water droplets arising on the throttle valve 34 from dew condensation are in a 0% frozen state, because by that throttle freeze protection operation it is possible to shake off the water droplets formed by dew condensation on the throttle valve 34, the throttle valve 34 can be prevented from progressing to a throttle-frozen state. And if the throttle freeze protection operation is executed with the water droplets condensed as dew on the throttle valve 34 in a semi-frozen state in which they are 50% frozen, because by that throttle freeze protection operation the water droplets having condensed as dew on the throttle valve 34 and ice formed by about half of that water freezing can be shaken off, similarly the throttle valve 34 can be prevented from progressing to a throttle-frozen state.

In the probability determination of whether or not the probability of the throttle valve 34 freezing is high, it is determined that the probability of the throttle valve 34 freezing is high when the engine temperature information Tw is below the predetermined value Tw0 (for example 0° C.), and the predetermined value Tw0 in this probability determination is set so that if dew condensation on the throttle occurs, the throttle freeze protection operation is executed before those water droplets reach a semi-frozen state. As a result, in the throttle freeze protection operation, the throttle valve drive device 36 is prevented from consuming excessive energy, and damage to the throttle valve drive device 36 and the throttle valve 34 and its drive mechanism can also be avoided.

The cooling water temperature sensor 27 is also a sensor used to calculate the fuel injection quantity of the fuel injection valve 37. In this third preferred embodiment, because the probability determination of whether or not the probability of the throttle valve 34 freezing is high is carried out on the basis of the engine temperature information Tw inputted from the cooling water temperature sensor 27, without any special sensor being added, as in the second preferred embodiment freezing of the throttle valve 34 can be certainly prevented without any increase in cost being incurred.

Fourth Preferred Embodiment

In this fourth preferred embodiment, the probability determination of whether or not the probability of the throttle valve 34 freezing is high is carried out using the date/time information DT from the date/time information outputting means 83 shown in FIG. 1, and when that probability is high, a throttle freeze protection operation is carried out. Whereas in the first preferred embodiment the environmental temperature information Tc from the environmental temperature sensor 82 was used, in the fourth preferred embodiment the date/time information outputting means 83 is used instead of the environmental temperature sensor 82. Otherwise, it is the same as the first preferred embodiment. Because the overall construction, and operation when the internal combustion engine 10 is running, of this fourth preferred embodiment are the same as in the first preferred embodiment, a description of these will be omitted.

In this fourth preferred embodiment, after the internal combustion engine 10 stops, when the date/time information DT inputted from the date/time information outputting means 83 is in a predetermined date range and time range, the control unit 80 determines that the probability of the throttle valve 34 freezing is high and sends the throttle freeze protection signal Sf to the throttle opening/closing control device 70. In accordance with the throttle freeze protection signal Sf from the control unit 80, the throttle opening/closing control device 70 drives the throttle valve drive device 36 and thereby oscillates the valve aperture of the throttle valve 34.

Figure 5:
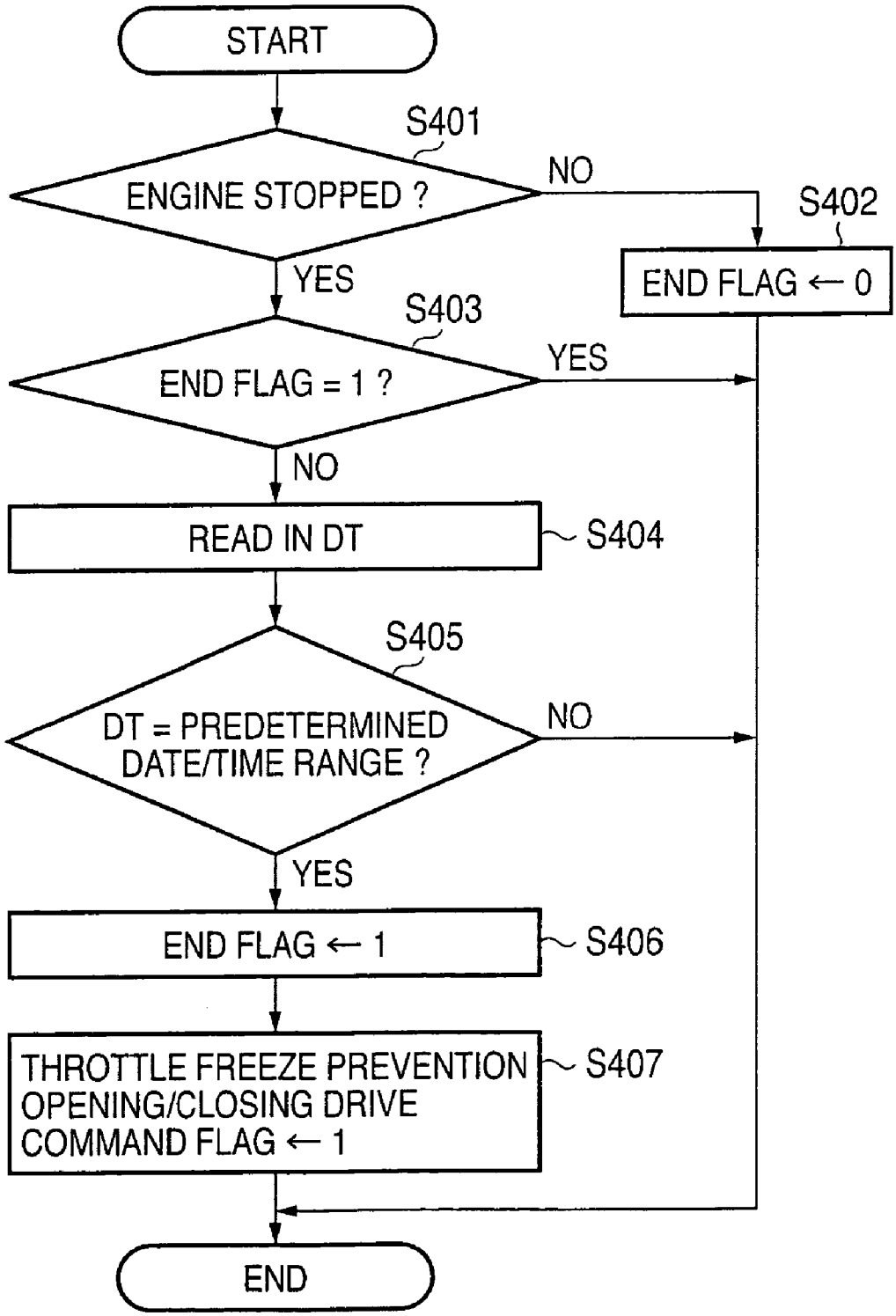
FIG. 5 is a control flow chart showing a throttle freeze protection operation in a fourth preferred embodiment of a control apparatus of an internal combustion engine according to the invention.

The throttle freeze protection operation in this fourth preferred embodiment will now be described with reference to the flow chart shown in FIG. 5. FIG. 5 is a control flow chart of the throttle freeze protection operation in the fourth preferred embodiment, and the control routine of this FIG. 5 is executed at intervals of a predetermined time (for example every 20 ms). The control flow chart of FIG. 5 includes seven steps S401 to S407. Steps S401, S402 and S403 are the same as steps S101, S102 and S103 of FIG. 2 and will not be described again here.

In step S403, when the end flag is not "1", because the determination result of step S403 is No, the control unit 80 proceeds to the next step S404 and reads in the date/time information DT from the date/time information outputting means 83. In the following step S405, it is determined whether the date information and time information included in the date/time information DT are in a predetermined date range and time range, for example between November and March and between 10 pm and 8 am. When the date information and time information included in the date/time information DT are not in the predetermined date range and time range, the determination result of step S405 is No, it is inferred that it is not necessary to carry out a throttle freeze protection operation, and the routine ends. When the date information and time information included in the date/time information DT are in the predetermined date range and time range, the determination result of step S405 is Yes, it is inferred that it is necessary to carry out a throttle freeze protection operation, in step S406 the end flag is set to "1", in the following step S407 the throttle freeze prevention opening/closing drive command flag is set to "1", and then the routine ends.

In this fourth preferred embodiment also, when the throttle freeze prevention opening/closing drive command flag is "1", in accordance with a control program (not shown) the control unit 80 supplies a throttle freeze protection signal Sf to the throttle opening/closing control device 70, and on the basis of this throttle freeze protection signal Sf the throttle opening/closing control device 70 executes a throttle freeze protection operation. In this throttle freeze protection operation, the throttle valve drive device 36 oscillates the valve aperture of the throttle valve 34.

The throttle freeze protection operation in this fourth preferred embodiment is the same as the throttle freeze protection operation in the first preferred embodiment, and by this throttle freeze protection operation it is possible to prevent freezing of the throttle valve 34.

In this fourth preferred embodiment also, when the internal combustion engine 10 is stopped, before the throttle valve 34 freezes, the control unit 80 performs a probability determination of whether or not the probability of the throttle valve 34 freezing is high, and, when it determines that this probability is high, causes a throttle freeze protection operation to be executed before the throttle valve 34 reaches a throttle-frozen state. Freezing of the throttle valve 34 occurs as a result of dew condensing on the throttle valve 34 and water droplets arising from this dew condensation then freezing. The state of water droplets arising from dew condensation on the throttle valve 34 having frozen 100% is here called the state of the throttle valve having frozen, that is, the throttle-frozen state. The throttle freeze protection operation conducted by the control unit 80 is executed before the water droplets arising from dew condensation have frozen 100%, and indeed before the water droplets reach a semi-frozen state in which they have frozen about 50%.

If a throttle freeze protection operation is executed when the water droplets arising on the throttle valve 34 from dew condensation are in a 0% frozen state, because by that throttle freeze protection operation it is possible to shake off the water droplets formed by dew condensation on the throttle valve 34, the throttle valve 34 can be prevented from progressing to a throttle-frozen state. And if the throttle freeze protection operation is executed with the water droplets condensed as dew on the throttle valve 34 in a semi-frozen state in which they are 50% frozen, because by that throttle freeze protection operation the water droplets having condensed as dew on the throttle valve 34 and ice formed by about half of that water freezing can be shaken off, similarly the throttle valve 34 can be prevented from progressing to a throttle-frozen state.

In this fourth preferred embodiment, in the probability determination of whether or not the probability of the throttle valve 34 freezing is high, it is determined that the probability of the throttle valve 34 freezing is high when the date information and time information of the date/time information DT are in a predetermined date range and time range, and the predetermined date range and time range in this probability determination are set so that if dew condensation on the throttle occurs, the throttle freeze protection operation is executed before those water droplets reach a semi-frozen state. As a result, in the throttle freeze protection operation, the throttle valve drive device 36 is prevented from consuming excessive energy, and damage to the throttle valve drive device 36 and the throttle valve 34 and its drive mechanism can also be avoided.

The predetermined date range and time range may alternatively be set in a combination, such as for example from 11 pm to 6 am in autumn and from 8 pm to 9 am in winter.

In this fourth preferred embodiment, because a throttle freeze protection operation is executed in seasons and time periods when freezing of the throttle valve 34 occurs the most readily, such as on winter nights, freezing of the throttle valve 34 can be prevented with energy being saved as well.

Fifth Preferred Embodiment

In this fifth preferred embodiment, the probability determination of whether or not the probability of the throttle valve 34 freezing is high is carried out using the location information Lo from the location sensor 84 shown in FIG. 1, and when that probability is high, a throttle freeze protection operation is carried out. Whereas in the first preferred embodiment the environmental temperature information Tc from the environmental temperature sensor 82 was used, in the fifth preferred embodiment the location sensor 84 is used instead of the environmental temperature sensor 82. Otherwise, it is the same as the first preferred embodiment. Because the overall construction, and operation when the internal combustion engine 10 is running, of this fifth preferred embodiment are the same as in the first preferred embodiment, a description of these will be omitted.

In this fifth preferred embodiment, after the internal combustion engine 10 stops, when the location information Lo inputted from the location sensor 84 is in a predetermined location range, the control unit 80 determines that the probability of the throttle valve 34 freezing is high and sends the throttle freeze protection signal Sf to the throttle opening/closing control device 70. In accordance with the throttle freeze protection signal Sf from the control unit 80, the throttle opening/closing control device 70 drives the throttle valve drive device 36 and thereby oscillates the valve aperture of the throttle valve 34.

Figure 6:
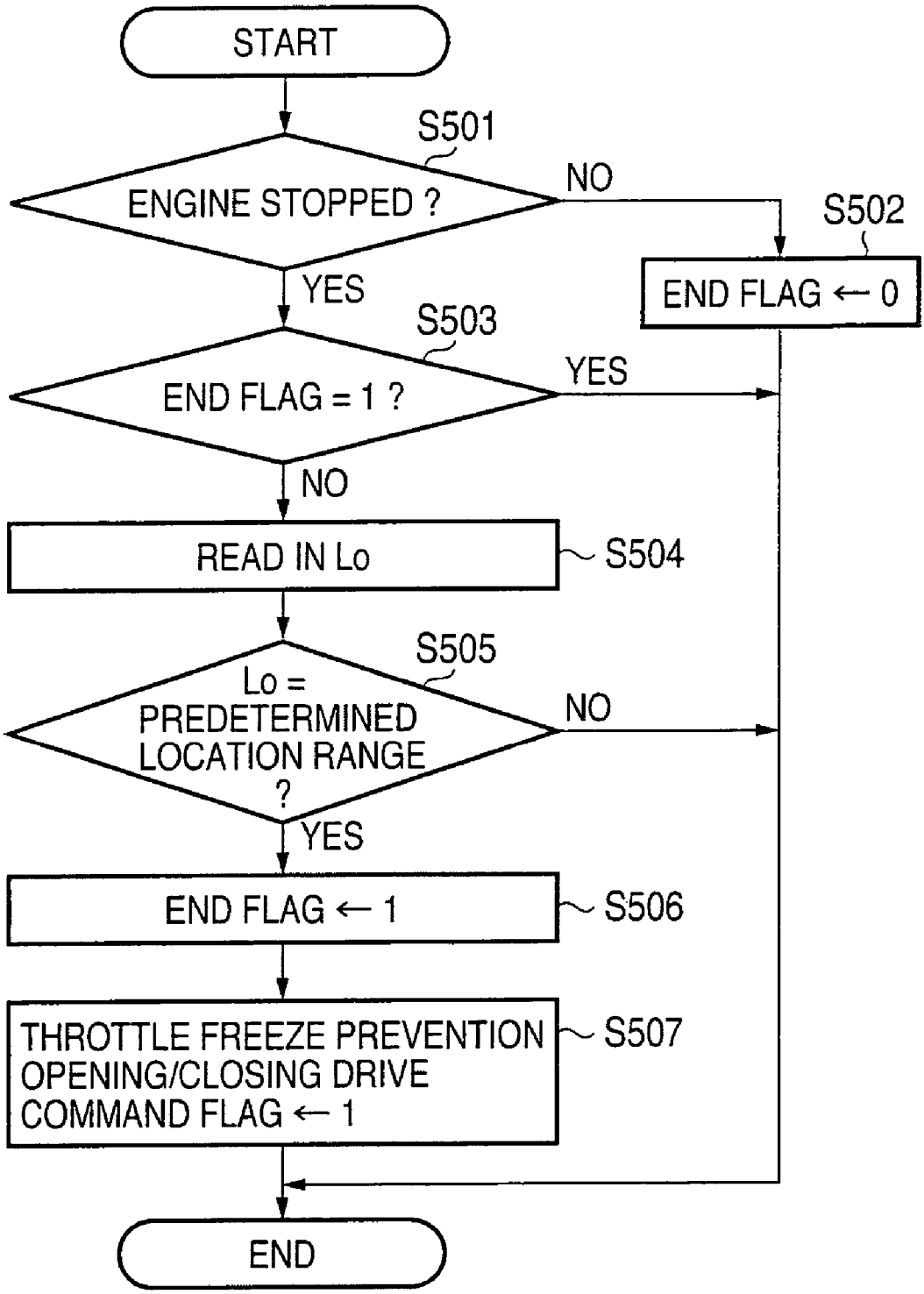
FIG. 6 is a control flow chart showing a throttle freeze protection operation in a fifth preferred embodiment of a control apparatus of an internal combustion engine according to the invention.

The throttle freeze protection operation in this fifth preferred embodiment will now be described with reference to the flow chart shown in FIG. 6. FIG. 6 is a control flow chart of the throttle freeze protection operation in the fifth preferred embodiment, and the control routine of this FIG. 6 is executed at intervals of a predetermined time (for example every 20 ms). The control flow chart of FIG. 6 includes seven steps S501 to S507. Steps S501, S502 and S503 are the same as steps S101, S102 and S103 of FIG. 2 and will not be described again here.

In step S503, when the end flag is not "1", because the determination result of step S503 is No, the control unit 80 proceeds to step S504 and reads in the location information Lo on where the internal combustion engine is located from the location sensor 84. In the following step S505, it is determined whether the location information Lo is in a predetermined location range (for example a cold region such as Hokkaido). When the location information Lo is not in the predetermined location range, the determination result of step S505 is No, it is inferred that it is not necessary to carry out a throttle freeze protection operation, and the routine ends. When the location information Lo is in the predetermined location range, the determination result of step S505 is Yes, it is inferred that it is necessary to carry out a throttle freeze protection operation, in step S506 the end flag is set to "1", in step S507 the throttle freeze prevention opening/closing drive command flag is set to "1", and then the routine ends.

In this fifth preferred embodiment also, when the throttle freeze prevention opening/closing drive command flag is "1", in accordance with a control program (not shown) the control unit 80 supplies a throttle freeze protection signal Sf to the throttle opening/closing control device 70, and on the basis of this throttle freeze protection signal Sf the throttle opening/closing control device 70 executes a throttle freeze protection operation. In this throttle freeze protection operation, the throttle valve drive device 36 oscillates the valve aperture of the throttle valve 34.

The throttle freeze protection operation in this fifth preferred embodiment is the same as the throttle freeze protection operation in the first preferred embodiment, and by this throttle freeze protection operation it is possible to prevent freezing of the throttle valve 34.

In this fifth preferred embodiment also, when the internal combustion engine 10 is stopped, before the throttle valve 34 freezes, the control unit 80 performs a probability determination of whether or not the probability of the throttle valve 34 freezing is high, and, when it determines that this probability is high, causes a throttle freeze protection operation to be executed before the throttle valve 34 reaches a throttle-frozen state. Freezing of the throttle valve 34 occurs as a result of dew condensing on the throttle valve 34 and water droplets arising from this dew condensation then freezing. The state of water droplets arising from dew condensation on the throttle valve 34 having frozen 100% is here called the state of the throttle valve having frozen, that is, the throttle-frozen state. The throttle freeze protection operation conducted by the control unit 80 is executed before the water droplets arising from dew condensation have frozen 100%, and indeed before the water droplets reach a semi-frozen state in which they have frozen about 50%.

If a throttle freeze protection operation is executed when the water droplets arising on the throttle valve 34 from dew condensation are in a 0% frozen state, because by that throttle freeze protection operation it is possible to shake off the water droplets formed by dew condensation on the throttle valve 34, the throttle valve 34 can be prevented from progressing to a throttle-frozen state. And if the throttle freeze protection operation is executed with the water droplets condensed as dew on the throttle valve 34 in a semi-frozen state in which they are 50% frozen, because by that throttle freeze protection operation the water droplets having condensed as dew on the throttle valve 34 and ice formed by about half of that water freezing can be shaken off, similarly the throttle valve 34 can be prevented from progressing to a throttle-frozen state.

In this fifth preferred embodiment, in the probability determination of whether or not the probability of the throttle valve 34 freezing is high, it is determined that the probability of the throttle valve 34 freezing is high when the location information Lo is in a predetermined location range, and the predetermined location range in this probability determination is set so that if dew condensation on the throttle occurs, the throttle freeze protection operation is executed before those water droplets reach a semi-frozen state. As a result, in the throttle freeze protection operation, the throttle valve drive device 36 is prevented from consuming excessive energy, and damage to the throttle valve drive device 36 and the throttle valve 34 and its drive mechanism can also be avoided.

The predetermined location range of the location information Lo may alternatively be set for example to anywhere in Hokkaido and over 1000 m above sea level, or anywhere in North America and above latitude 45°, or may be set to any region in a subpolar or polar zone.

In this fifth preferred embodiment, because a throttle freeze protection operation is executed in locations where freezing of the throttle valve 34 occurs the most readily, such as cold regions and high-altitude regions, freezing of the throttle valve 34 can be prevented with energy being saved as well.

Sixth Preferred Embodiment

In this sixth preferred embodiment, the probability determination of whether or not the probability of the throttle valve 34 freezing is high is carried out on the basis of the operation history of the recirculating valve device 52 of the exhaust recirculating device 50 while the internal combustion engine 10 was operating, and when that probability is high, a freeze protection operation of the throttle valve 34 is carried out. Whereas in the first preferred embodiment the environmental temperature information Tc from the environmental temperature sensor 82 was used, in the sixth preferred embodiment the operation history of the recirculating valve device 52 of the exhaust recirculating device 50 is used instead of the environmental temperature sensor 82. Otherwise, it is the same as the first preferred embodiment. Because the overall construction, and operation when the internal combustion engine 10 is running, of this sixth preferred embodiment are the same as in the first preferred embodiment, a description of these will be omitted.

The recirculating valve device 52 of the exhaust recirculating device 50 recirculates exhaust gas from the exhaust pipe 41 to the intake pipe 31 while the internal combustion engine 10 is running, and historical information on the valve aperture of the recirculating valve device 52 while the internal combustion engine 10 is running is stored in memory in the control unit 80. This valve aperture history of the recirculating valve device 52 is accumulated during running of the internal combustion engine 10, and it remains even when the internal combustion engine 10 stops, but when operation of the internal combustion engine 10 starts the next time it is reset. In this sixth preferred embodiment, after the internal combustion engine 10 stops, the control unit 80 refers to this valve aperture history of the recirculating valve device 52 pertaining to the previous operation of the internal combustion engine 10 stored in memory, and when the maximum valve aperture is above a predetermined valve aperture (for example above 50%), it determines that the probability of the throttle valve 34 freezing is high and sends the throttle freeze protection signal Sf to the throttle opening/closing control device 70. In accordance with the throttle freeze protection signal Sf from the control unit 80, the throttle opening/closing control device 70 drives the throttle valve drive device 36 and thereby oscillates the valve aperture of the throttle valve 34.

Figure 7:
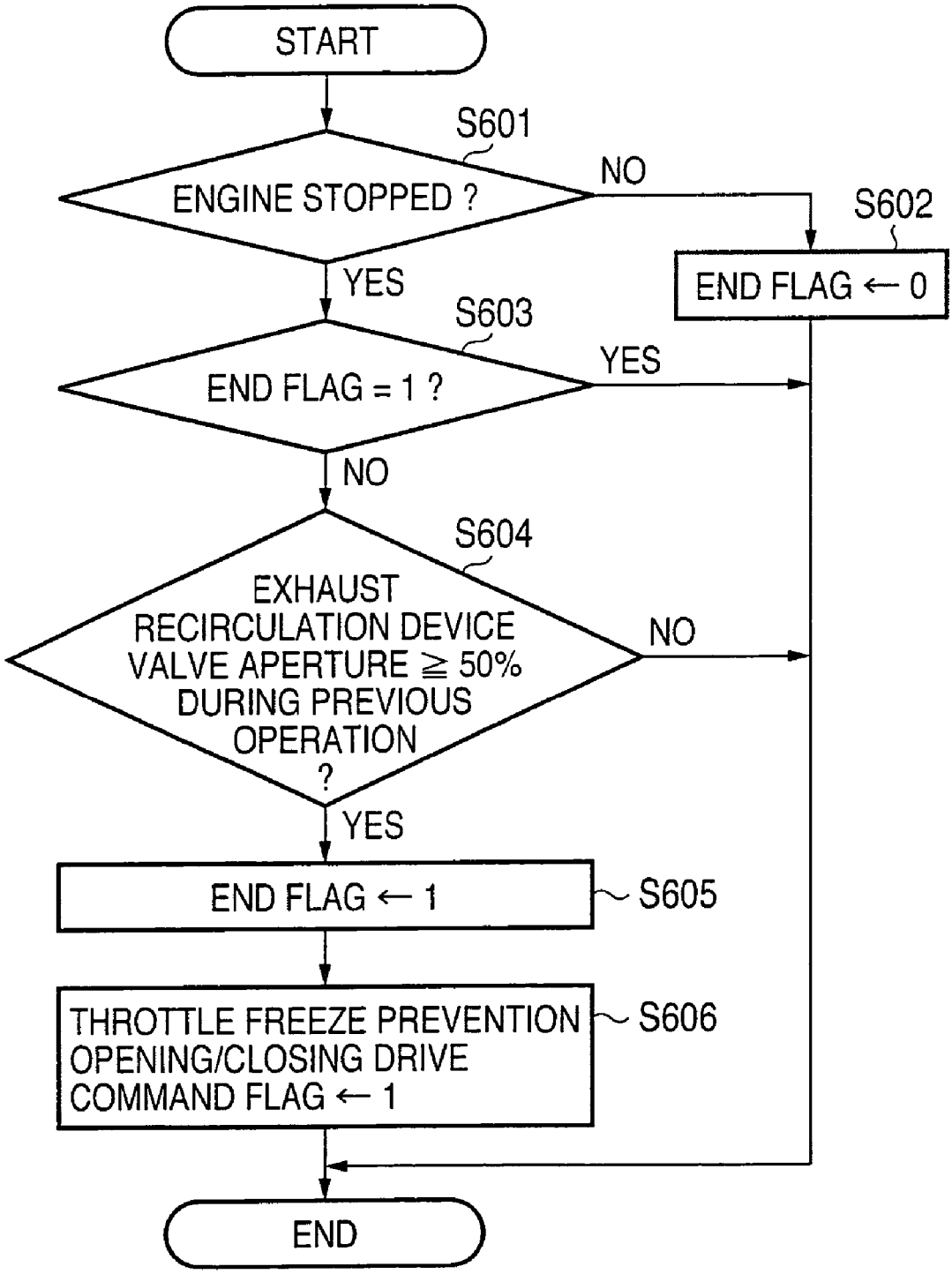
FIG. 7 is a control flow chart showing a throttle freeze protection operation in a sixth preferred embodiment of a control apparatus of an internal combustion engine according to the invention.

The throttle freeze protection operation in this sixth preferred embodiment will now be described with reference to the flow chart shown in FIG. 7. FIG. 7 is a control flow chart of the throttle freeze protection operation in the sixth preferred embodiment, and the control routine of this FIG. 7 is executed at intervals of a predetermined time (for example every 20 ms). The control flow chart of FIG. 7 includes six steps S601 to S606. Steps S601, S602 and S603 are the same as steps S101, S102 and S103 of FIG. 2 and will not be described again here.

In step S603, when the end flag is not "1", because the determination result of step S603 is No, in step S604 the control unit 80 determines whether the maximum valve aperture of the recirculating valve device 52 in the previous operation of the internal combustion engine 10 is above a predetermined value (for example 50%). When the maximum valve aperture of the recirculating valve device 52 in the previous operation of the internal combustion engine 10 is not above the predetermined value, the determination result of step S604 is No, it is inferred that it is not necessary to carry out a throttle freeze protection operation, and the routine ends. When the maximum valve aperture of the recirculating valve device 52 in the previous operation of the internal combustion engine 10 is above the predetermined value, the determination result of step S604 is Yes, it is inferred that it is necessary to carry out a throttle freeze protection operation, in step S605 the end flag is set to "1", instep S606 the throttle freeze prevention opening/closing drive command flag is set to "1", and then the routine ends.

In this sixth preferred embodiment also, when the throttle freeze prevention opening/closing drive command flag is "1", in accordance with a control program (not shown) the control unit 80 supplies a throttle freeze protection signal Sf to the throttle opening/closing control device 70, and on the basis of this throttle freeze protection signal Sf the throttle opening/closing control device 70 executes a throttle freeze protection operation. In this throttle freeze protection operation, the throttle valve drive device 36 oscillates the valve aperture of the throttle valve 34.

The throttle freeze protection operation in this sixth preferred embodiment is the same as the throttle freeze protection operation in the first preferred embodiment, and by this throttle freeze protection operation it is possible to prevent freezing of the throttle valve 34.

In this sixth preferred embodiment also, when the internal combustion engine 10 is stopped, before the throttle valve 34 freezes, the control unit 80 performs a probability determination of whether or not the probability of the throttle valve 34 freezing is high, and, when it determines that this probability is high, causes a throttle freeze protection operation to be executed before the throttle valve 34 reaches a throttle-frozen state. Freezing of the throttle valve 34 occurs as a result of dew condensing on the throttle valve 34 and water droplets arising from this dew condensation then freezing. The state of water droplets arising from dew condensation on the throttle valve 34 having frozen 100% is here called the state of the throttle valve having frozen, that is, the throttle-frozen state. The throttle freeze protection operation conducted by the control unit 80 is executed before the water droplets arising from dew condensation have frozen 100%, and indeed before the water droplets reach a semi-frozen state in which they have frozen about 50%.

If a throttle freeze protection operation is executed when the water droplets arising on the throttle valve 34 from dew condensation are in a 0% frozen state, because by that throttle freeze protection operation it is possible to shake off the water droplets formed by dew condensation on the throttle valve 34, the throttle valve 34 can be prevented from progressing to a throttle-frozen state. And if the throttle freeze protection operation is executed with the water droplets condensed as dew on the throttle valve 34 in a semi-frozen state in which they are 50% frozen, because by that throttle freeze protection operation the water droplets having condensed as dew on the throttle valve 34 and ice formed by about half of that water freezing can be shaken off, similarly the throttle valve 34 can be prevented from progressing to a throttle-frozen state.

In this sixth preferred embodiment, in the probability determination of whether or not the probability of the throttle valve 34 freezing is high, it is determined that the probability of the throttle valve 34 freezing is high when the maximum valve aperture of the recirculating valve device 52 in the previous operation of the internal combustion engine 10 is above the predetermined value, and the predetermined value in this probability determination is set so that if dew condensation on the throttle occurs, the throttle freeze protection operation is executed before those water droplets reach a semi-frozen state. As a result, in the throttle freeze protection operation, the throttle valve drive device 36 is prevented from consuming excessive energy, and damage to the throttle valve drive device 36 and the throttle valve 34 and its drive mechanism can also be avoided.

If when the internal combustion engine 10 is running the flow of exhaust gas recirculated by the exhaust recirculating device 50 rises above a predetermined level, the probability of the throttle valve 34 freezing after the internal combustion engine 10 stops is high. In this sixth preferred embodiment, because a throttle freeze protection operation is carried out when the probability of the throttle valve 34 freezing is high as a result of exhaust gas recirculation, freezing of the throttle valve 34 can be prevented with energy being saved as well.

Although here it was determined whether or not the probability of the throttle valve 34 freezing is high on the basis of the valve aperture history of the recirculating valve device 52 of the previous operation of the internal combustion engine 10, alternatively an exhaust gas recirculation flow may be calculated from a recirculation valve aperture and an operating state of the internal combustion engine 10 and the probability of the throttle valve 34 freezing then determined on the basis of this. Or, a recirculated exhaust gas flow may be estimated when the internal combustion engine is stopped on the basis of a recirculating valve aperture of immediately before the internal combustion engine 10 stopped, and the probability of the throttle valve 34 freezing then determined on the basis of this.

Seventh Preferred Embodiment

In this seventh preferred embodiment, the control unit 80 starts the throttle freeze protection operation after a predetermined standby time has elapsed from the time at which the internal combustion engine 10 stopped. Otherwise, it is the same as the first preferred embodiment.

In this seventh preferred embodiment, as in the first preferred embodiment, while the internal combustion engine 10 is stopped, when the environmental temperature information Tc inputted from the environmental temperature sensor 82 is below a predetermined value (for example 0° C.), the control unit 80 determines that the probability of the throttle valve 34 freezing is high and sends the throttle freeze protection signal Sf to the throttle opening/closing control device 70. In accordance with the throttle freeze protection signal Sf, the throttle opening/closing control device 70 drives the throttle valve drive device 36 and thereby applies an oscillating motion to the throttle valve 34. In this seventh preferred embodiment, when the control unit 80 has determined that the probability of the throttle valve 34 freezing is high, it stands by until a predetermined standby time T1 (for example 1 hour) has elapsed from the time at which the internal combustion engine 10 stopped, and carries out a throttle freeze protection operation after this standby time T1 elapses.

Figure 8:
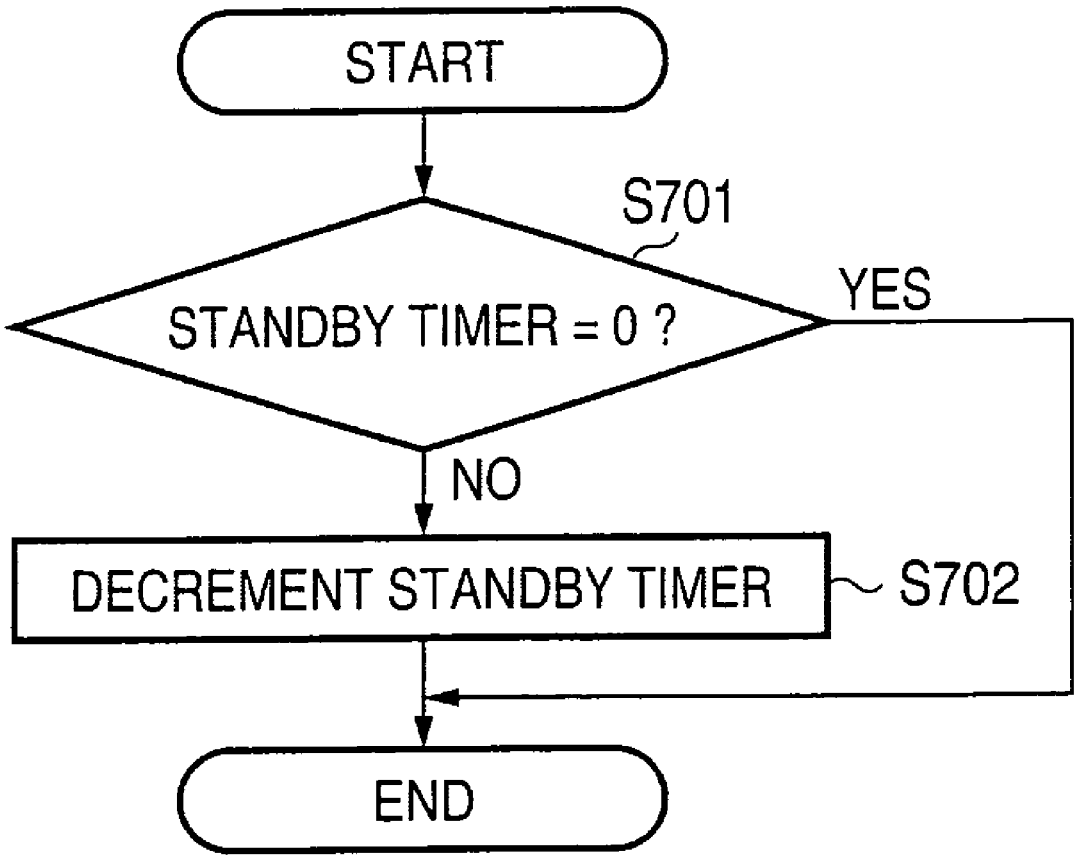
FIG. 8 is a control flow chart showing a control operation of a standby timer in a seventh preferred embodiment of a control apparatus of an internal combustion engine according to the invention.

The throttle freeze protection operation in this seventh preferred embodiment will now be described with reference to FIG. 8 and FIG. 9. FIG. 8 is a flowchart of standby time timing carried out for the internal combustion engine 10, executed at intervals of a predetermined time (for example every 500 ms). This flow chart of FIG. 8 includes two steps S701, S702. In step S701, first it is determined whether a standby timer is at 0, and when the standby timer is at 0, because the determination result of step S701 is Yes, it is inferred that the standby time T1 has elapsed, and the routine ends. When the standby timer is not at 0, because the determination result of step S701 is No, the control unit 80 carries out a decrementing of the standby timer in Step S702.

Figure 9:
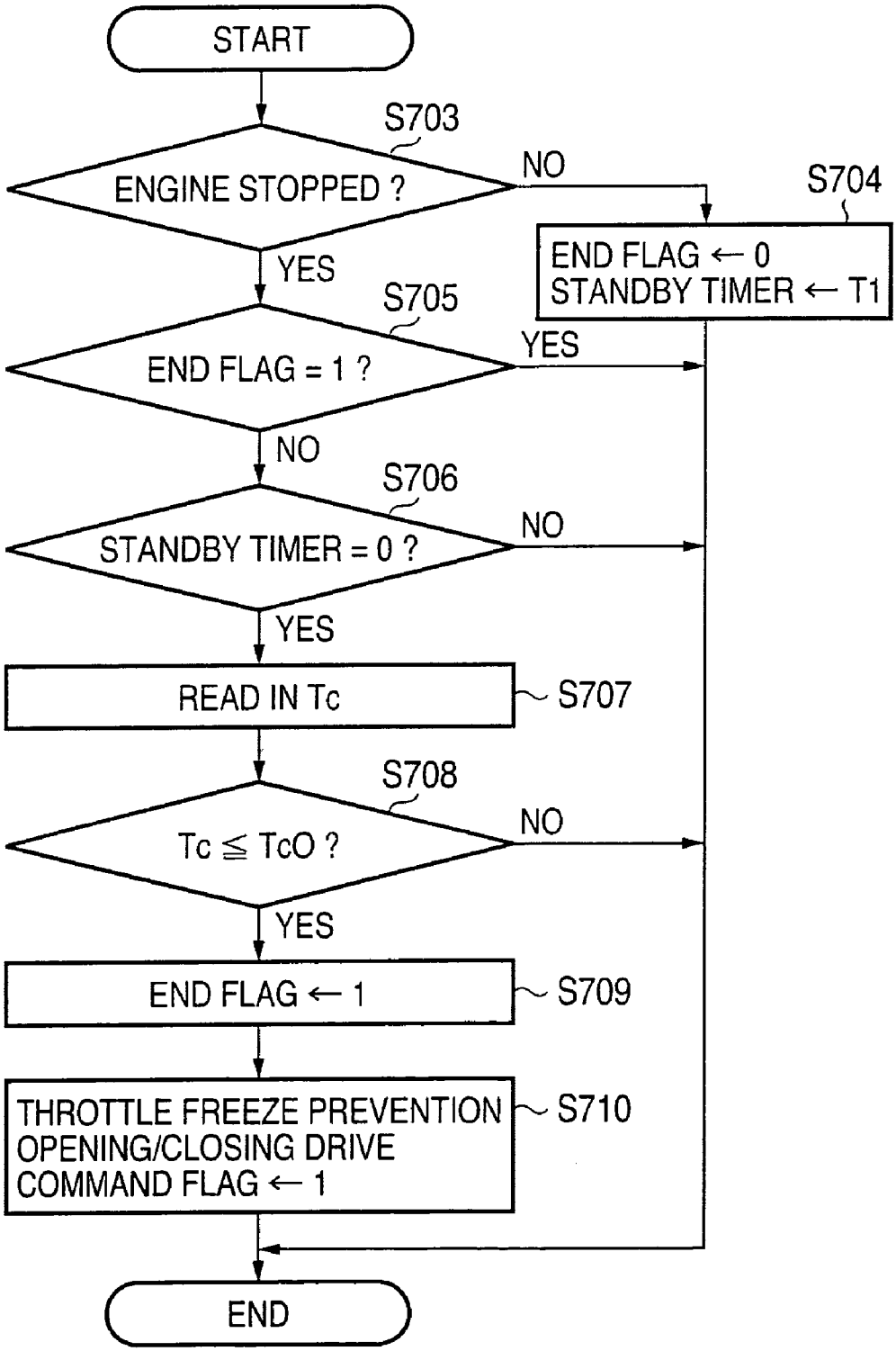
FIG. 9 is a control flow chart showing a throttle freeze protection operation in the seventh preferred embodiment.

FIG. 9 is a control flow chart of the throttle freeze protection operation in the seventh preferred embodiment, executed at intervals of a predetermined time (for example 20 ms). This flow chart includes eight steps S703 to S710.

First, in step S703, the control unit 80 determines for example on the basis of a signal from the crank angle sensor (not shown) whether the internal combustion engine 10 has stopped, and when the internal combustion engine 10 has not stopped, because the determination result of step S703 is No, it proceeds to step S704, sets the end flag to "0", sets the standby time to T1 (for example 1 hour), and then the routine ends. When the internal combustion engine 10 has stopped, because the determination result of step S703 is Yes, processing proceeds to step S705 and determines whether the end flag is "1". When the end flag is "1", the determination result of step S705 is Yes, it is inferred that the throttle freeze protection operation has ended, and the routine ends.

When the end flag is not "1", the determination result of step S705 is No, and processing proceeds to the next step S706. In step S706, it is determined whether the standby timer is at 0, and if the standby timer is not at 0 the determination result of step S706 is No and the control unit 80 determines it is standing by, and the routine ends. When the standby timer is 0, because the determination result of step S706 is Yes, processing proceeds to the following step S707 and reads in the environmental temperature information Tc from the environmental temperature sensor 82. In the next step S708, it is determined whether the environmental temperature information Tc inputted from the environmental temperature sensor 82 is below the predetermined value Tc0 (for example below 0° C.). When the environmental temperature information Tc is not below the predetermined value Tc0, the determination result of step S708 is No, it is inferred that it is not necessary to carry out a throttle freeze protection operation, and the routine ends. When the environmental temperature information Tc is below the predetermined value Tc0, the determination result of step S708 is Yes, it is inferred it is necessary to carry out a throttle freeze protection operation, in step S709 the end flag is set to "1", in step S710 the throttle freeze prevention opening/closing drive command flag is set to "1", and the routine ends.

In this seventh preferred embodiment, after a standby time T1 elapses from when the internal combustion engine 10 stops, when the throttle freeze prevention opening/closing drive command flag is "1", in accordance with a control program (not shown) the control unit 80 supplies a throttle freeze protection signal Sf to the throttle opening/closing control device 70, and on the basis of this throttle freeze protection signal Sf the throttle opening/closing control device 70 executes a throttle freeze protection operation. In this throttle freeze protection operation, the throttle valve drive device 36 oscillates the valve aperture of the throttle valve 34.

The throttle freeze protection operation in this seventh preferred embodiment is the same as the throttle freeze protection operation in the first preferred embodiment, and by this throttle freeze protection operation it is possible to prevent freezing of the throttle valve 34.

In this seventh preferred embodiment, when the internal combustion engine 10 is stopped, after the standby time T1 elapses from when the internal combustion engine 10 stopped, before the throttle valve 34 freezes, the control unit 80 performs a probability determination of whether or not the probability of the throttle valve 34 freezing is high, and, when it determines that this probability is high, causes a throttle freeze protection operation to be executed before the throttle valve 34 reaches a throttle-frozen state. Freezing of the throttle valve 34 occurs as a result of dew condensing on the throttle valve 34 and water droplets arising from this dew condensation then freezing. The state of water droplets arising from dew condensation on the throttle valve 34 having frozen 100% is here called the state of the throttle valve having frozen, that is, the throttle-frozen state. The throttle freeze protection operation conducted by the control unit 80 is executed before the water droplets arising from dew condensation have frozen 100%, and indeed before the water droplets reach a semi-frozen state in which they have frozen about 50%.

If a throttle freeze protection operation is executed when the water droplets arising on the throttle valve 34 from dew condensation are in a 0% frozen state, because by that throttle freeze protection operation it is possible to shake off the water droplets formed by dew condensation on the throttle valve 34, the throttle valve 34 can be prevented from progressing to a throttle-frozen state. And if the throttle freeze protection operation is executed with the water droplets condensed as dew on the throttle valve 34 in a semi-frozen state in which they are 50% frozen, because by that throttle freeze protection operation the water droplets having condensed as dew on the throttle valve 34 and ice formed by about half of that water freezing can be shaken off, similarly the throttle valve 34 can be prevented from progressing to a throttle-frozen state.

In this seventh preferred embodiment, after the standby time T1 elapses from when the internal combustion engine 10 stopped, the control unit 80 performs a probability determination of whether or not the probability of the throttle valve 34 freezing is high, and in this probability determination it is determined that the probability of the throttle valve 34 freezing is high when the environmental temperature information Tc is below a predetermined value Tc0 (for example 0° C.). In this seventh preferred embodiment, the standby time T1 and the predetermined value Tc0 in the, probability determination are set so that if dew condensation on the throttle occurs, after the standby time T1 elapses, the throttle freeze protection operation is executed before those water droplets reach a semi-frozen state. As a result, in the throttle freeze protection operation, the throttle valve drive device 36 is prevented from consuming excessive energy, and damage to the throttle valve drive device 36 and the throttle valve 34 and its drive mechanism can also be avoided.

When the internal combustion engine 10 is running, the temperature of the throttle body 33 including the throttle valve 34 may rise, and in this case dew condensation will not occur immediately after the internal combustion engine 10 stops, but rather dew condensation occurs after a certain time elapses from when the internal combustion engine 10 stopped, when the throttle body 33 including the throttle valve 34 has fully cooled. And, freezing of water droplets does not occur simultaneously with the occurrence of dew condensation, but rather freezing of the water droplets occurs after a certain time elapses from the occurrence of dew condensation, and the throttle valve 34 freezes when these water droplets have frozen approximately 100%.

With this seventh preferred embodiment, after the internal combustion engine 10 stops, a freezing prevention operation of the throttle valve 34 can be carried out at the time at which the throttle valve 34 is most likely to freeze, before the throttle valve 34 becomes throttle-frozen, and freezing of the throttle valve can be prevented without fail.

Although in the seventh preferred embodiment the standby time T1 set in the standby timer was fixed, alternatively it may be made to change with the environmental temperature or the like. And whereas in the seventh preferred embodiment the determination of the probability of the throttle valve 34 freezing was carried out on the basis of the environmental temperature information Tc, alternatively it may be carried out on the basis of the intake air temperature information Ta, the engine temperature information Tw, date/time information DT including date information and time information, location information Lo or the valve aperture history of the exhaust recirculating device 50. In this case also, the standby time T1, and the predetermined value Ta0 of the intake air temperature information Ta, the predetermined value Tc0 of the environmental temperature information Tc, the predetermined date information and time information of the date/time information DT, the location range of the location information Lo, and the predetermined value of the valve aperture of the recirculating valve device 52 used in the probability determination of whether or not the probability of the throttle valve 34 freezing is high are set so that the throttle freeze protection operation is executed after the standby time T1 elapses and, even if dew condenses on the throttle, before the water droplets reach a semi-frozen state.

Eighth Preferred Embodiment

In this eighth preferred embodiment, after a predetermined standby time elapses from when the internal combustion engine 10 stopped, the control unit 80 starts a throttle freeze protection operation of the throttle valve 34 and performs the freeze protection operation K1 times (K1 being an integer) at predetermined time intervals. Otherwise, the construction is the same as that of the first preferred embodiment.

In this eighth preferred embodiment, while the internal combustion engine 10 is stopped, after a standby time T1 has elapsed from when the internal combustion engine 10 stopped, when the environmental temperature information Tc inputted from the environmental temperature sensor 82 is below a predetermined value (for example 0° C.), the control unit 80 determines that probability of the throttle valve 34 freezing is high, and at predetermined intervals sends the throttle freeze protection signal Sf to the throttle opening/closing control device 70, K1 times. In accordance with the throttle freeze protection signal Sf, the throttle opening/closing control device 70 drives the throttle valve drive device 36 and thereby applies an oscillating motion to the throttle valve 34. In this eighth preferred embodiment, when the control unit 80 has determined that the probability of the throttle valve 34 freezing is high, it stands by until a predetermined standby time T1 (for example 1 hour) has elapsed from the time at which the internal combustion engine 10 stopped, and after this standby time T1 elapses carries out K1 throttle freeze protection operations with intervals of a predetermined time (for example 30 minutes) between them.

Specifically, when the control unit 80 has determined that the probability of the throttle valve 34 freezing is high, it stands by until the standby time T1 (for example 1 hour) elapses from when the internal combustion engine 10 stopped, and after this standby time T1 elapses it carries out a first throttle freeze protection operation. And after carrying out the first throttle freeze protection operation, the control unit 80 repeats the throttle freeze protection operation at intervals of a predetermined time (for example 30 minutes). Here, the total number of times the throttle freeze protection operation is carried out is a predetermined number of times K1 (for example five times) set in an interval counter.

Figure 10:
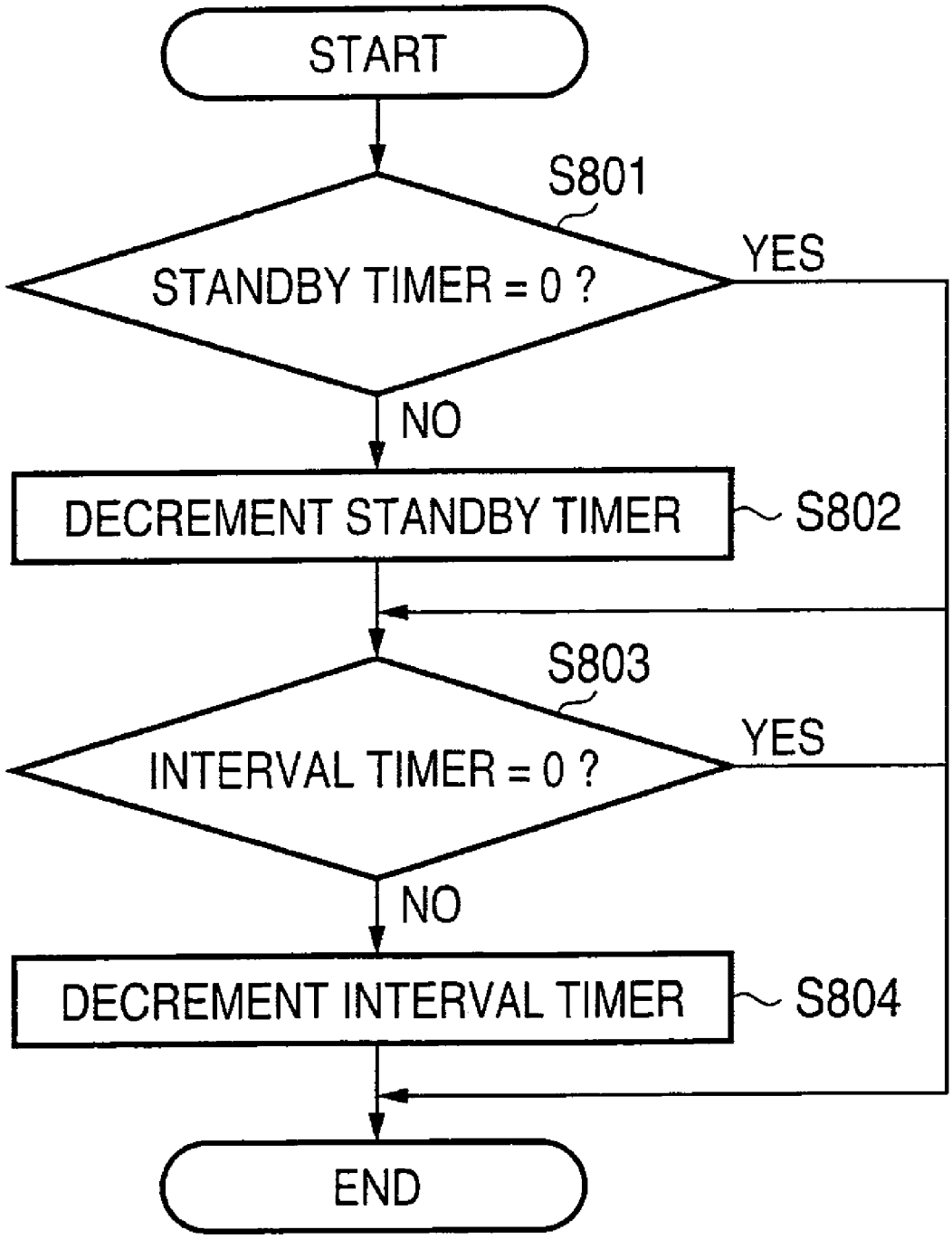
FIG. 10 is a flow chart showing a control operation of a standby timer and an interval timer in an eighth preferred embodiment of a control apparatus of an internal combustion engine according to the invention.

The throttle freeze protection operation of this eighth preferred embodiment will now be described with reference to the flow charts shown in FIG. 10 and FIG. 11. FIG. 10 is a flow chart according to which standby time timing and interval time timing are performed in the eighth preferred embodiment, and is executed at intervals of a predetermined time (for example every 500 ms). This flow chart of FIG. 10 includes four steps S801 to S804.

First, in step S8 01, it is determined whether the standby timer is at 0, and when the standby timer is at 0 the determination result of step S801 is Yes and it is inferred that the standby time T1 has elapsed. When the standby timer is not at 0 the determination result of step S801 is No and in step S802 decrementing of the standby timer is carried out. In the following step S803, a determination of whether the interval timer is at 0 is performed. When the interval timer is 0, the determination result of step S803 is Yes and it is inferred that the interval time as elapsed. When the interval timer is not at 0, the determination result of step S803 is No, processing proceeds to step S804, a decrementing of the interval timer is carried out and then the routine ends.

Figure 11:
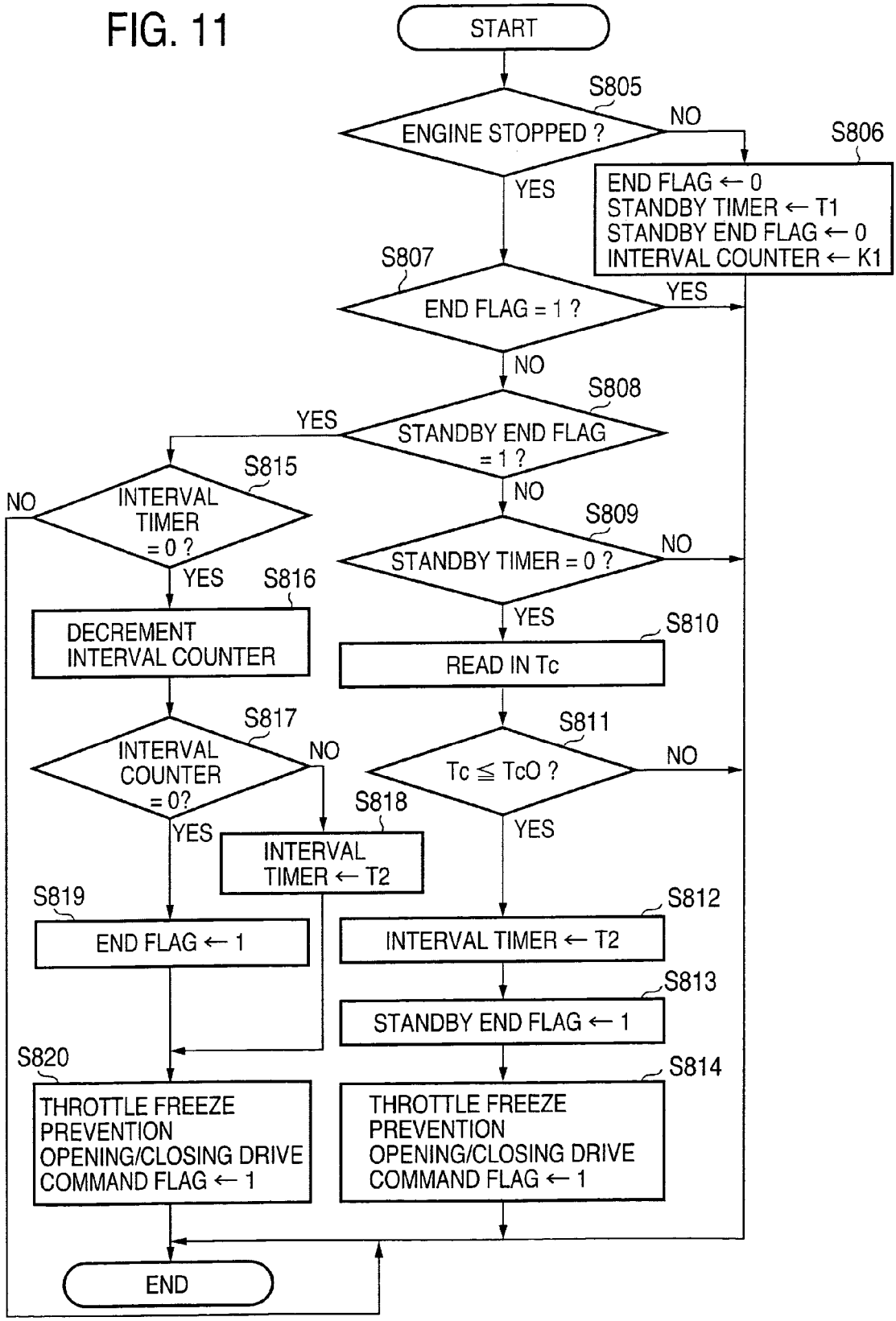
FIG. 11 is a control flow chart showing a throttle freeze protection operation in the eighth preferred embodiment.

FIG. 11 is a control flow chart of the throttle freeze protection operation in the eighth preferred embodiment, executed at intervals of a predetermined time (for example every 20 ms). This flow chart of FIG. 11 includes sixteen steps S805 to S820.

First, in step S805, the throttle control unit 80 determines for example on the basis of a signal from the crank angle sensor (not shown) whether the internal combustion engine 10 has stopped. When the internal combustion engine 10 has not stopped, the determination result of step S805 is No and processing proceeds to step S806. In this step S806, the end flag is set to "0", the standby timer to T1 (for example 1 hour), a standby end flag to "0", and an interval counter to K1 (for example 5times), and then the routine ends. When the internal combustion engine 10 has stopped, the determination result of step S805 is Yes and processing proceeds to the next step S807. In this step S807, it is determined whether the end flag is "1", and when the end flag is "1" the determination result of step S807 is Yes, it is inferred that the throttle freeze protection operation has ended, and the routine ends. When the end flag is not "1", the determination result of step S807 is No, and processing proceeds to the following step S808.

In this step S808, it is determined whether the standby end flag is 1. When the standby end flag is not 1, the determination result of step S808 is No, and processing proceeds to step S809. In this step S809, it is determined whether the standby timer is at 0, and when the standby timer is not at 0 the determination result of step S809 is No and the control unit 80 determines it is standing by, and the routine ends. When the standby timer is 0, the determination result of step S809 is Yes, processing proceeds to the next step S810, in this step S810 the environmental temperature information Tc is read in from the environmental temperature sensor 82, and then processing proceeds to the following step S811.

In this step S811, it is determined whether the environmental temperature information Tc inputted from the environmental temperature sensor 82 is below a predetermined value Tc0 (for example below 0° C.). When the environmental temperature information Tc is not below the predetermined value Tc0, the determination result of step S811 is No, it is inferred that it is not necessary to carry out a throttle freeze protection operation, and the routine ends. When the environmental temperature information Tc inputted from the environmental temperature sensor 82 is below the predetermined value Tc0, the determination result of step S811 is Yes, it is inferred that it is necessary to carry out a throttle freeze protection operation, and processing proceeds to the following steps S812, S813, S814. In step S812, the interval timer is set to T2 (for example 30 minutes), in step S813 the standby end flag is set to "1", in step S814 the throttle freeze prevention opening/closing drive command flag is set to "1", and then the routine ends.

When the standby end flag is 1, the determination result of step S808 is Yes, and in the following step S815 it is determined whether the interval timer is at 0. When the interval timer is not at 0, the determination result of step S815 is No, the control unit 80 determines that it is standing by, and the routine ends. When the interval timer is 0, the determination result of step S815 is Yes, and in the next step S816 a decrementing of the interval counter is carried out, and processing proceeds to step S817. In step S817, it is determined whether the interval counter is at 0.

When the interval counter is not at 0, the determination result of step S817 is No, processing proceeds to step S818 and the interval timer is set to T2, and in the next step S820 the throttle freeze prevention opening/closing drive command flag is set to "1". When the interval counter is 0, the determination result of step S817 is Yes, in step S819 the end flag is set to "1", and in the next step S820 the throttle freeze prevention opening/closing drive command flag is set to "1", and the routine ends.

In this eighth preferred embodiment, after the standby time T1 elapses from when the internal combustion engine 10 stopped, when the throttle freeze prevention opening/closing drive command flag is "1", every time a predetermined interval elapses, up to K1 times, the control unit 80 supplies a throttle freeze protection signal Sf to the throttle opening/closing control device 70 and on the basis of this throttle freeze protection signal Sf the throttle opening/closing control device 70 executes a throttle freeze protection operation. In this throttle freeze protection operation, the throttle valve drive device 36 oscillates the valve aperture of the throttle valve 34.

In this eighth preferred embodiment, each of the K1 throttle freeze protection operations carried out at intervals of the predetermined time is the same as the throttle freeze protection operation in the first preferred embodiment, and by these throttle freeze protection operations it is possible to prevent freezing of the throttle valve 34.

In this eighth preferred embodiment, after the standby time T1 elapses from when the internal combustion engine 10 is stopped, before the throttle valve 34 freezes, the control unit 80 performs a probability determination of whether or not the probability of the throttle valve 34 freezing is high, and, when it determines that this probability is high, causes K1 throttle freeze protection operations to be executed, each before the throttle valve 34 reaches a throttle-frozen state, with intervals of a predetermined time between them. Freezing of the throttle valve 34 occurs as a result of dew condensing on the throttle valve 34 and water droplets arising from this dew condensation then freezing. The state of water droplets arising from dew condensation on the throttle valve 34 having frozen 100% is here called the state of the throttle valve having frozen, that is, the throttle-frozen state. Each of the K1 throttle freeze protection operations conducted by the control unit 80 is executed before the water droplets arising from dew condensation have frozen 100%, and indeed before the water droplets reach a semi-frozen state in which they have frozen about 50%.

If a throttle freeze protection operation is executed when the water droplets arising on the throttle valve 34 from dew condensation are in a 0% frozen state, because by that throttle freeze protection operation it is possible to shake off the water droplets formed by dew condensation on the throttle valve 34, the throttle valve 34 can be prevented from progressing to a throttle-frozen state. And if the throttle freeze protection operation is executed with the water droplets condensed as dew on the throttle valve 34 in a semi-frozen state in which they are 50% frozen, because by that throttle freeze protection operation the water droplets having condensed as dew on the throttle valve 34 and ice formed by about half of that water freezing can be shaken off, similarly the throttle valve 34 can be prevented from progressing to a throttle-frozen state.

In this eighth preferred embodiment, the standby time T1, the interval time T2, and the predetermined value Tc0 of the environmental temperature information Tc used in the probability determination of whether or not-the probability of the throttle valve 34 freezing is high are set so that, after the standby time elapses, and after each time the interval time, elapses thereafter, even if dew condensation on the throttle occurs, the throttle freeze protection operation is executed before those water droplets reach a semi-frozen state. As a result, in the throttle freeze protection operation, the throttle valve drive device 36 is prevented from consuming excessive energy, and damage to the throttle valve drive device 36 and the throttle valve 34 and its drive mechanism can also be avoided.

When the internal combustion engine 10 is running, the temperature of the throttle body 33 including the throttle valve 34 may rise, and in this case dew condensation will not occur immediately after the internal combustion engine 10 stops, but rather dew condensation occurs after a certain time elapses from when the internal combustion engine 10 stopped, when the throttle body 33 including the throttle valve 34 is fully cooled. At this time, it often happens that dew condenses in small quantities over a long period after this certain time elapses, and water droplets arising from this dewing freeze gradually.

With this eighth preferred embodiment it is possible to carry out a throttle freeze protection operation repeatedly over the period in which dewing is likely to occur, and dew condensation and freezing occurring a little at a time can be removed without fail and freezing of the throttle valve can be prevented without fail.

Although in this eighth preferred embodiment the standby time T1 set in the standby timer, the interval time T2 set in the interval timer and the predetermined number of times K1 set in the interval counter are fixed, alternatively they may be made to change with the environmental temperature or the like. And whereas in the eighth preferred embodiment the determination of the probability of the throttle valve 34 freezing was carried out on the basis of the environmental temperature information Tc, alternatively it may be carried out on the basis of the intake air temperature information Ta, the engine temperature information Tw, date/time information DT including date information and time information, location information Lo or the valve aperture history of the exhaust recirculating device 50. In this case also, the standby time T1, the interval time T2, and the predetermined value Ta0 of the intake air temperature information Ta, the predetermined value Tc0 of the environmental temperature information Tc, the predetermined date information and time information of the date/time information DT, the location range of the location information Lo, and the predetermined value of the valve aperture of the recirculating valve device 52 used in the probability determination of whether or not the probability of the throttle valve 34 freezing is high are set so that the throttle freeze protection operation is executed, after the standby time T1 elapses and after each time the interval time T2 elapses thereafter and, even if dew condenses on the throttle, before the water droplets reach a semi-frozen state.

Ninth Preferred Embodiment

In this ninth preferred embodiment, when the internal combustion engine 10 is stopped, even when the control unit 80 has determined that the probability of the throttle valve 34 freezing is high, if the power supply voltage of the battery 61 is lower than a predetermined value V (for example 11V), throttle freeze protection operation is prohibited. Otherwise, the construction is the same as that of the first preferred embodiment.

Specifically, in this ninth preferred embodiment, while the internal combustion engine 10 is stopped, when the environmental temperature information Tc inputted from the environmental temperature sensor 82 is below a predetermined value Tc0 (for example 0° C.), the control unit 80 determines that the probability of the throttle valve 34 freezing is high. However, in this ninth preferred embodiment, even when the control unit 80 determines that the probability of the throttle valve 34 freezing is high, if the power supply voltage of the battery 61 is lower than a predetermined value V (for example 11V), throttle freeze protection operation is prohibited. The battery 61 is a 12V system battery and normally maintains a power supply voltage of about 13V, and when its voltage falls below 11V the battery 61 is in an over-discharged state.

Figure 12:
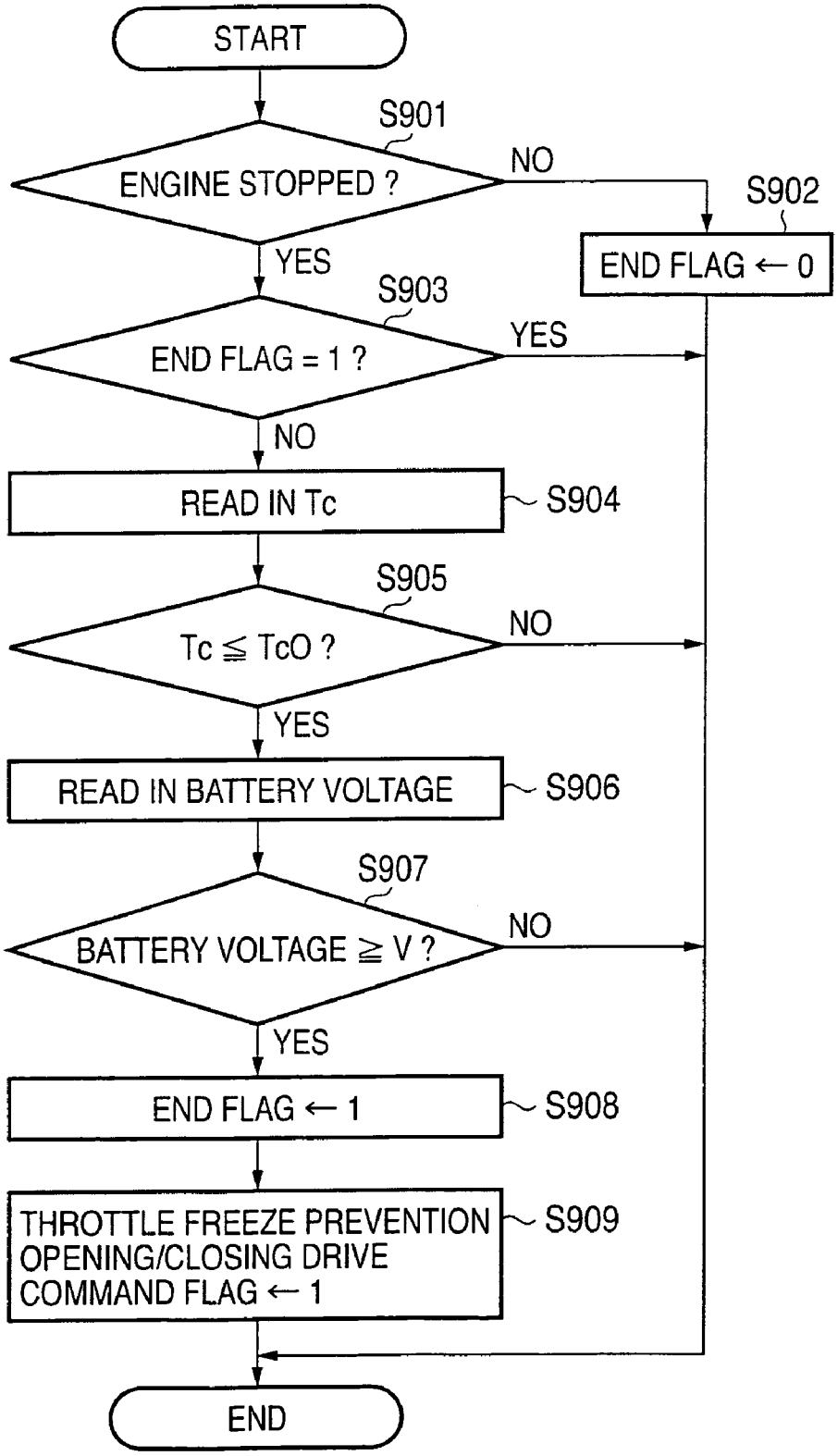
FIG. 12 is a control flow chart showing a throttle freeze protection operation in a ninth preferred embodiment of a control apparatus of an internal combustion engine according to the invention.

The throttle freeze protection operation in this ninth preferred embodiment will now be described with reference to FIG. 12. FIG. 12 is a control flow chart of the throttle freeze protection operation in the ninth preferred embodiment, executed at intervals of a predetermined time (for example every 20 ms). This flow chart of FIG. 12 includes nine steps S901 to S909. Steps S901 to S905 are the same as steps S101 to S105 shown in FIG. 2 and therefore will not be described again here.

In step S904, when the environmental temperature information Tc inputted from the environmental temperature sensor 82 is below the predetermined value Tc0, the determination result of step S905 is Yes and it is determined that it is necessary to carry out a throttle freeze protection operation. However, in this case, in the next step S906, the power supply voltage of the battery 61 is read in, and in the next step S907 it is determined whether the power supply voltage of the battery 61 is above a predetermined value V (for example 11v). When the power supply voltage of the battery 61 is not the predetermined value V or more, the determination result of step S907 is No and then the routine ends. In this case, the throttle freeze protection operation is prohibited. When the power supply voltage of the battery 61 is not the predetermined value V, the determination result of step S905 is Yes, and in the next step S908 the end flag is set to "1", in the following step S909 the throttle freeze prevention opening/closing drive command flag is set to "1", and then the routine ends.

In this ninth preferred embodiment also, when the throttle freeze prevention opening/closing drive command flag is "1", in accordance with a control program (not shown), the control unit 80 supplies a throttle freeze protection signal Sf to the throttle opening/closing control device 70 and on the basis of this throttle freeze protection signal Sf the throttle opening/closing control device 70 executes a throttle freeze protection operation. In this throttle freeze protection operation, the throttle valve drive device 36 oscillates the valve aperture of the throttle valve 34.

The throttle freeze protection operation in this ninth preferred embodiment is the same as the throttle freeze protection operation in the first preferred embodiment, and by this throttle freeze protection operation it is possible to prevent freezing of the throttle valve 34.

With this ninth preferred embodiment, when the power supply voltage of the battery 61 ancillary to the internal combustion engine 10 is below a predetermined value V, by prohibiting throttle freeze protection operation by the throttle valve drive device 36 it is possible to prevent over-discharging of the battery 61 caused by throttle freeze protection operation.

Although in the ninth preferred embodiment the power supply voltage of the battery 61 at which throttle freeze protection operation is prohibited is fixed, alternatively it may be made to change with the environmental temperature or the like. And whereas in the ninth preferred embodiment the determination of the probability of the throttle valve 34 freezing was carried out on the basis of the environmental temperature information Tc; alternatively it may be carried out on the basis of the intake air temperature information Ta, the engine temperature information Tw, date/time information DT including date information and time information, location information Lo or the valve aperture history of the exhaust recirculating device 50.

A control apparatus of an internal combustion engine according to the invention can be used in all kinds of automotive vehicles, including passenger vehicles and trucks.

What is claimed is:

1. A control apparatus of an internal combustion engine, comprising:

a battery ancillary to the internal combustion engine;

a control unit for receiving power from the battery and controlling the internal combustion engine; and a throttle valve drive device for receiving power from the battery and driving a throttle valve of the internal combustion engine, the control apparatus of the internal combustion engine regulating the valve aperture of the throttle valve by controlling the throttle valve drive device while the internal combustion engine is running, wherein while the internal combustion engine is stopped the control unit receives power from the battery and performs a probability determination of whether or not the probability of the throttle valve freezing is high, and when while the internal combustion engine is stopped it determines that the probability of the throttle valve freezing is high the control unit, before the throttle valve reaches a throttle-frozen state, controls the throttle valve drive device so that the throttle valve drive device receives power from the battery and executes a freeze protection operation of oscillating the valve aperture of the throttle valve.

2. A control apparatus of an internal combustion engine according to claim 1, wherein the freeze protection operation includes an operation of bringing the valve aperture of the throttle valve to fully open and an operation of bringing the valve aperture to fully closed.

3. A control apparatus of an internal combustion engine according to claim 1, wherein the freeze protection operation includes an operation of bringing the valve aperture of the throttle valve to one of fully-open and fully closed and an operation of bringing the valve aperture to half open.

4. A control apparatus of an internal combustion engine according to claim 1, further comprising environmental temperature detecting means for detecting an environmental temperature of the internal combustion engine and outputting environmental temperature information corresponding to this environmental temperature, wherein the control unit performs the probability determination on the basis of this environmental temperature information.

5. A control apparatus of an internal combustion engine according to claim 1, further comprising intake air temperature detecting means for detecting the air temperature in an intake air pipe of the internal combustion engine and outputting intake air temperature information corresponding to this air temperature, wherein the control unit performs the probability determination on the basis of the intake air temperature information.

6. A control apparatus of an internal combustion engine according to claim 1, further comprising engine temperature detecting means for detecting a temperature of the internal combustion engine and outputting engine temperature information corresponding to that temperature, wherein the control unit performs the probability determination on the basis of the engine temperature information.

7. A control apparatus of an internal combustion engine according to claim 6, wherein a cooling water temperature detector for detecting a cooling water temperature of the internal combustion engine is used as the engine temperature detecting means.

8. A control apparatus of an internal combustion engine according to claim 1, wherein the control unit performs the probability determination on the basis of date/time information including date information and time information.

9. A control apparatus of an internal combustion engine according to claim 1, further comprising location detecting means for detecting a location on a map where the internal combustion engine is located and outputting location information corresponding to that location, wherein the control unit performs the probability determination on the basis of the location information.

10. A control apparatus of an internal combustion engine according to claim 1, the internal combustion engine having an exhaust recirculating device for recirculating exhaust gas to an intake air pipe thereof, wherein the control unit performs the probability determination on the basis of a drive level of the exhaust recirculating device of when the engine was running.

11. A control apparatus of an internal combustion engine according to claim 1, wherein the control unit starts the freeze protection operation after a predetermined standby time elapses from the time at which the internal combustion engine stopped.

12. A control apparatus of an internal combustion engine according to claim 1, wherein after a predetermined standby time elapses from the time at which the internal combustion engine stopped, the control unit controls the throttle valve drive device to perform the freeze protection operation multiple times with a predetermined time interval between each time.

13. A control apparatus of an internal combustion engine according to claim 1, wherein when while the internal combustion engine is stopped the power supply voltage of the battery is below a predetermined value, the freeze protection operation conducted by the control unit is prohibited.

* * * * *